US011846107B2

(12) United States Patent
Smith et al.

(10) Patent No.: US 11,846,107 B2
(45) Date of Patent: Dec. 19, 2023

(54) COLLAPSIBLE UTILITY SCAFFOLD

(71) Applicant: Grady F. Smith & Co., Inc., Greenville, NC (US)

(72) Inventors: Grady F. Smith, Greenville, NC (US); Jon Benavides, Sterling Heights, MI (US)

(73) Assignee: GRADY F. SMITH & CO., INC., Greenville, NC (US)

( * ) Notice: Subject to any disclaimer, the term of this patent is extended or adjusted under 35 U.S.C. 154(b) by 0 days.

(21) Appl. No.: 17/886,675

(22) Filed: Aug. 12, 2022

(65) Prior Publication Data

US 2023/0049059 A1 Feb. 16, 2023

Related U.S. Application Data

(60) Provisional application No. 63/232,440, filed on Aug. 12, 2021, provisional application No. 63/232,467, filed on Aug. 12, 2021.

(51) Int. Cl.
*E04G 7/32* (2006.01)
*E04G 1/30* (2006.01)
(Continued)

(52) U.S. Cl.
CPC ..... *E04G 1/30* (2013.01); *E04G 1/04* (2013.01); *E04G 1/12* (2013.01); *E04G 7/304* (2013.01);
(Continued)

(58) Field of Classification Search
CPC ..... F16B 7/22; Y10T 403/30; Y10T 403/295; E04G 1/04; E04G 1/12; E04G 1/30;
(Continued)

(56) References Cited

U.S. PATENT DOCUMENTS 2,588,905 A * 3/1952 Blackburn ..... E04G 7/308 403/49
2,830,855 A * 4/1958 Hyre ..... E04G 7/304 403/353
(Continued)

FOREIGN PATENT DOCUMENTS

CN 2654765 Y 11/2004
GB 1489411 A * 10/1977 ..... E04G 1/152

*Primary Examiner* — Daniel J Wiley

(74) *Attorney, Agent, or Firm* — COATS & BENNETT, PLLC

(57) ABSTRACT

A utility scaffold is designed to be repeatedly broken down into straighter components to reduce the space requirement for storage and shipment. The scaffold has first and second ladder frames, each comprising a plurality of vertical supports, a plurality of horizontal supports, and a plurality of releasable connections. The horizontal supports are releasably connected to the vertical supports by the releasable connections to form a rigid ladder frame structure. The releasable connections include a male wedge protrusion and a female receiver configured to receive the male wedge protrusion. The female receiver has a passage therethrough, with the passage having a tapered interior surface. The male wedge protrusion and the tapered interior surface are configured to abut when the vertical support and the horizontal support are mounted together via the releasable connection. A fastener is optionally used to secure the releasable connection.

20 Claims, 26 Drawing Sheets

(51) Int. Cl.
*E04G 1/12* (2006.01)
*E04G 1/04* (2006.01)
*E04G 7/30* (2006.01)

(52) U.S. Cl.
CPC ..... *E04G 7/32* (2013.01); *E04G 2001/305* (2013.01)

(58) Field of Classification Search
CPC ..... E04G 7/308; E04G 7/304; E04G 7/307; E04G 7/32; E04G 7/006
See application file for complete search history.

(56) References Cited

U.S. PATENT DOCUMENTS 2,833,421 A * 5/1958 Skubic ..... A47B 47/027 403/49
3,028,928 A * 4/1962 Jucuiano ..... E04G 1/18 182/178.1
3,273,921 A * 9/1966 Young ..... E04G 7/307 403/49
3,817,641 A * 6/1974 Steele ..... E04G 7/307 403/256
4,039,264 A * 8/1977 Sharp ..... F16B 7/0486 403/49
4,226,551 A * 10/1980 Beasley ..... F16B 7/0493 403/219
4,340,318 A * 7/1982 Frosch ..... F16B 7/22 52/81.3
4,430,019 A * 2/1984 D'Alessio ..... E04G 7/26 182/178.1
4,525,096 A 6/1985 Green et al.
4,599,010 A * 7/1986 Hocking ..... E04G 7/307 411/537
4,718,787 A * 1/1988 Bahloul ..... F16B 7/22 403/175
4,867,274 A * 9/1989 Langer ..... E04G 7/32 52/638
5,317,855 A * 6/1994 De Leeuw ..... E04G 25/06 248/354.3
5,333,964 A * 8/1994 Thomas ..... F16B 7/02 403/339
5,476,345 A * 12/1995 Papadopoulos ..... E04G 7/304 403/353
5,605,204 A * 2/1997 Ausejo ..... E04G 7/307 182/186.7
5,819,872 A 10/1998 Krause
6,152,263 A * 11/2000 Van Oers ..... E04G 5/147 182/186.8
6,283,251 B1 * 9/2001 Merkel ..... E04G 7/308 182/186.7
2004/0028466 A1 * 2/2004 Tsai ..... F16B 7/22 403/231
2013/0126270 A1 * 5/2013 Darby ..... E04G 5/14 256/65.01
2013/0177346 A1 * 7/2013 Brinkmann ..... B23K 9/0282 228/164
2015/0152654 A1 * 6/2015 Yamane ..... E04G 7/32 403/187
2016/0002936 A1 * 1/2016 Cox ..... E04G 1/152 403/376
2019/0211572 A1 * 7/2019 Yang ..... E04G 7/307

* cited by examiner

COLLAPSIBLE UTILITY SCAFFOLD

This application claims benefit of U.S. Provisional Application No. 63/232,440 filed 12 Aug. 2021, and U.S. Provisional Application No. 63/232,467, filed 12 Aug. 2021, the disclosures of both of which are incorporated herein by reference in their entirety.

The present disclosure relates generally to scaffolding and, more particularly, to a collapsible utility scaffold designed to conserve space during storage and shipment.

BACKGROUND

A common utility scaffold that is in widespread use comprises two spaced apart frames interconnected by removable cross braces to form a rectangular scaffold. The frames include stacking pins at the upper end to allow individual units of the scaffold to be vertically stacked. The frames of the utility scaffold are typically unitary in construction takes up a large amount of space for packaging and storage. The space requirement makes shipping and storage cumbersome. Additionally, the space requirement is a significant factor in the cost of shipping and adds significantly to the cost of the product to the end user. Therefore, there remains a need to reduce the space requirement for shipping and storing scaffolding.

SUMMARY

The present disclosure relates to a utility scaffold that is designed to be collapsible with a significantly reduced space requirement for storage and packaging without compromising strength and rigidity of the assembled scaffold. The utility scaffold can be easily disassembled for storage or shipment and is efficient in terms of space utilization. The more efficient space utilization significantly reduces costs for shipping and storing the product and ultimately reduces the cost to the end user.

The scaffold includes a ladder frame that is designed to be disassembled into individual components for compact storage without compromising strength and rigidity of the scaffold. The individual components include male and/or female portions of releasable connections for joining the individual components together when the scaffold is in use. The connections are designed to provide a secure connection and torsional rigidity without compromising the strength of the frame. The releasable connections use a tapered interface that prevents relative rotation between the male and female portions of the releasable connection. In the some embodiments disclosed herein, a combination of straight connectors and angled connections are used; in some other embodiments disclosed herein only angled releasable connections are used.

In one or more aspects, a collapsible scaffold is disclosed. The collapsible scaffold includes first and second ladder frames and a plurality of cross braces. The first and second ladder frames each include a plurality of vertical supports, a plurality of horizontal supports, and a plurality of releasable connections. The horizontal supports are configured to be releasably connected to the vertical supports to enable disassembly of the ladder frames into component parts for storage or transport (e.g., shipment). The releasable connections are for releasably connecting the horizontal supports to the vertical supports to form a rigid ladder frame structure. The cross braces are configured to be releasably connected to both the first and second ladder frames to form a self-supporting scaffold. The releasable connections include a male wedge protrusion and a female receiver. The female receiver is configured to receive the male wedge protrusion. The female receiver has a passage therethrough, with the passage having a tapered interior surface. The male wedge protrusion is affixed to one of a vertical support and a horizontal support, and the female receiver is affixed to the other of the vertical support and the horizontal support. The male wedge protrusion and the tapered interior surface are configured to abut when the vertical support and the horizontal support are mounted together via the releasable connection. A fastener is optionally used to secure the releasable connection. This construction of the ladder frames allows the first and second ladder frames to be repeatably changeable between an assembled state and an disassembled state. In the assembled state, the horizontal supports are mounted to the vertical supports via a plurality of releasable connections to form a rigid ladder frame structure. In the disassembled state, the horizontal supports and the vertical supports are dismounted from each other.

In other aspects, method(s) of using a scaffold are disclosed. The includes forming a first ladder frame by: 1) releasably mounting an upper horizontal support between first and second outer vertical supports by securing a plurality of releasable connections; and 2) releasably mounting a lower horizontal support between the first and second outer vertical supports by securing another plurality of releasable connections. Each of the releasable connections includes a male wedge protrusion received in a female receiver having a passage therethrough, with the passage having a tapered interior surface. The male wedge protrusions are associated with the horizontal supports and the female receivers are associated with the vertical supports. The male wedge protrusion and the tapered interior surface abut when the releasable connection is secured. The method also includes connecting the first ladder frame to a second ladder frame to form a rigid structure via a plurality of cross braces, wherein each cross brace is mounted to both the first ladder frame and the second ladder frame. Optionally, the second ladder frame is substantially identical to the first ladder frame. The method optionally also includes thereafter, disassembling the scaffold by: 1) disconnecting the first ladder from the second ladder frame by dismounting the cross braces from at least the first ladder frame; and 2) disassembling the first ladder frame such that the upper horizontal support, the lower horizontal support, the first and second outer vertical supports are all dismounted from each other.

Other aspects of the components, the scaffold, and related methods are also evident from the following description and corresponding drawings.

BRIEF DESCRIPTION OF THE DRAWINGS

FIG. 10C is a cross-section taken along line 10C-10C of FIG. 10B.

FIG. 11B is a cross-section taken along line 11B-11B of FIG. 11A.

FIG. 12C is a cross-section taken along line 12C-12C of FIG. 12B.

FIG. 13B is a cross-section taken along line 13B-13B of FIG. 13A.

FIG. 29B is a cross-section take along line H-H of FIG. 29A. FIG. 29C is a cross-section of an alternative version of the flange of FIG. 29A, taken along line H-H in FIG. 29A.

DETAILED DESCRIPTION

Figure 1:
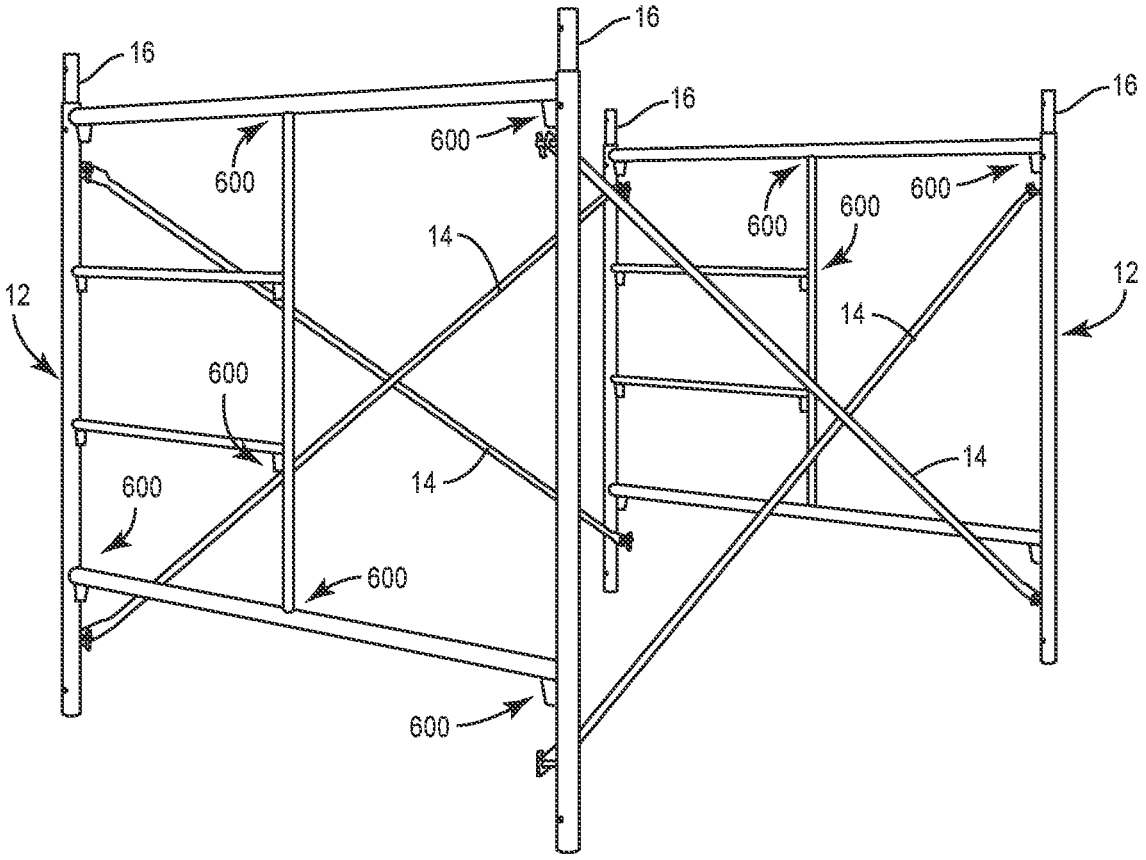
FIG. 1 illustrates an exemplary utility scaffold according to an exemplary embodiment with releasable connections on the ladder frames omitted for clarity.

FIG. 1 illustrates a utility scaffold 10 according to an exemplary embodiment. The scaffold 10 comprises two spaced apart ladder frames 12 interconnected by removable cross braces 14 to form a rectangular scaffold 10. The ladder frames 12 include stacking pins 16 at the upper end thereof to allow individual units of the scaffold 10 to be vertically stacked to build a higher scaffold. As will be hereinafter described, the scaffold 10 is designed to be broken down into straighter components and stored in a compact space to reduce the volume occupied by the disassembled scaffold 10.

Each ladder frame 12 of the scaffold 10 comprise two vertical supports 20, two horizontal supports 30, a center support 40 and two ladder rungs 50 extending between one of the vertical supports 20 and the center support 40 to form a ladder for climbing the scaffold 10. The vertical supports 20, horizontal supports 30, center support 40 and ladder rungs 50 all comprise circular metal tubing. The cross braces 14 may comprise circular metal tubing with flattened ends where the cross braces 14 connect with the frames 12. The flattened ends may have openings formed therein that engage with inwardly projecting latch posts 100 on the vertical supports 20 of the ladder frames 12. The stacking pins 16 insert into the upper ends of the vertical supports 20 to enable vertical stacking of individual scaffold units to create a higher scaffold.

Figure 2:
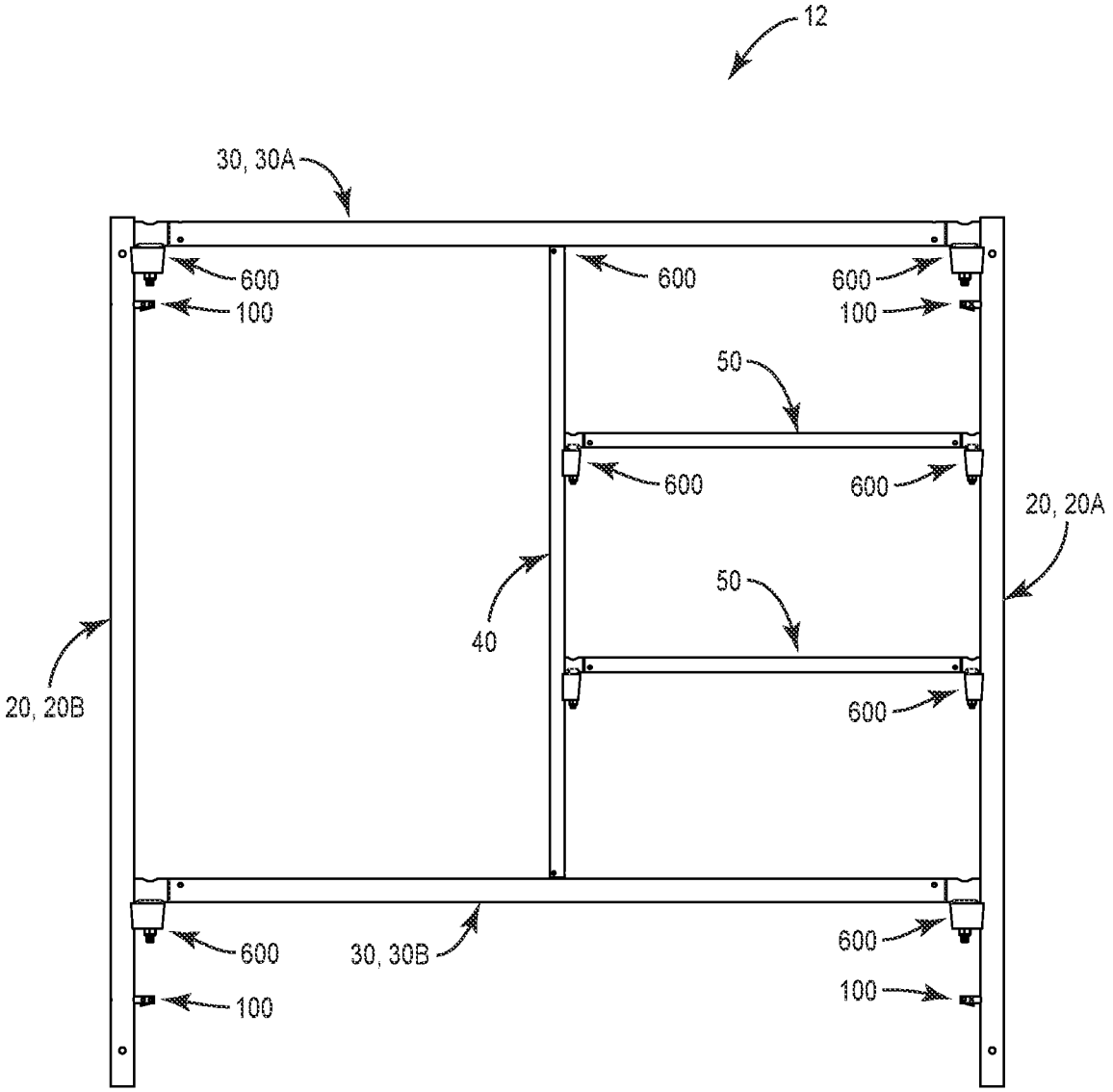
FIG. 2 illustrates an exemplary ladder frame for a utility scaffold designed to be broken down into individual components.
Figure 3:
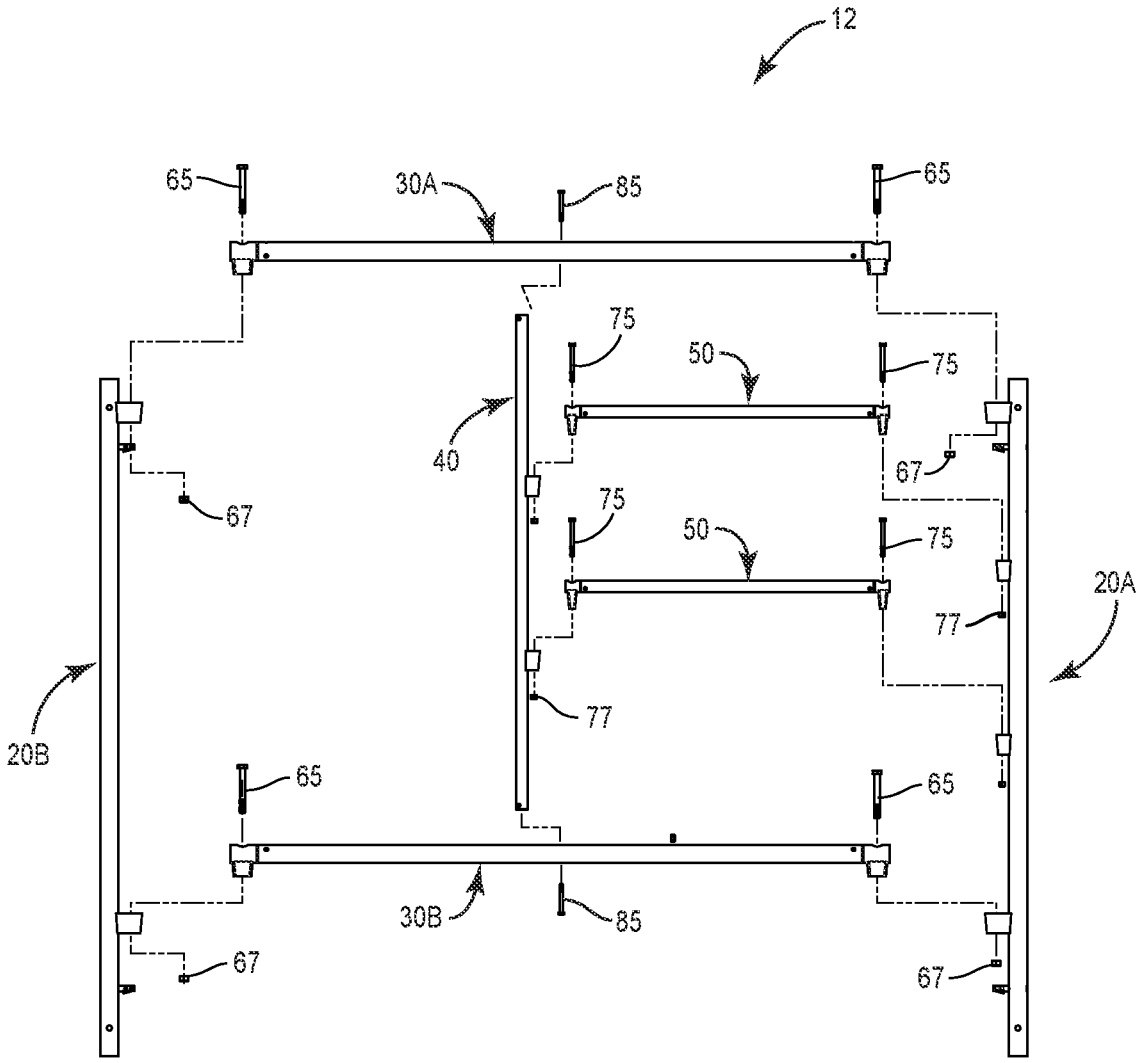
FIG. 3 is an exploded view of the ladder frame.

FIGS. 2 and 3 illustrate the ladder frame 12 for the scaffold 10 in more detail. The ladder frame 12 is designed to be disassembled into individual components for compact storage without compromising strength and rigidity of the scaffold 10. The individual components include male and/or female connectors for joining the individual components together when the scaffold 10 is in use. The connectors are designed to provide a secure connection and torsional rigidity without compromising the strength of the frame 12. The connectors all use a tapered interface that prevents relative rotation between the male and female connectors. In the exemplary embodiments disclosed herein, a combination of straight connectors and angled connectors are used. In the case of the straight connectors, the axis of the interface is parallel to the longitudinal axis of the individual component with the male connector and angled (e.g., $0,<\alpha\leq 90$ degrees) with respect the longitudinal axis of the individual component with the female connector. In the case of the angled connectors, the axis of the interface is angled (e.g., $0,<\alpha\leq 90$ degrees) with respect to the longitudinal axis of the individual component with the male connector and parallel to the longitudinal axis of the individual component with the female connector. In the exemplary embodiment, the horizontal supports 30 each include angled male connectors 70 that mate with corresponding female connectors 60 in the vertical supports 14. Similarly, the rungs 50 include angled male connectors 70' that mate with female connectors 60' in a vertical support 20 or center support 40. The center support 40 includes straight male connectors 90 at each end that mate with compatible female connectors 80 in the horizontal supports 30.

Figure 4A:
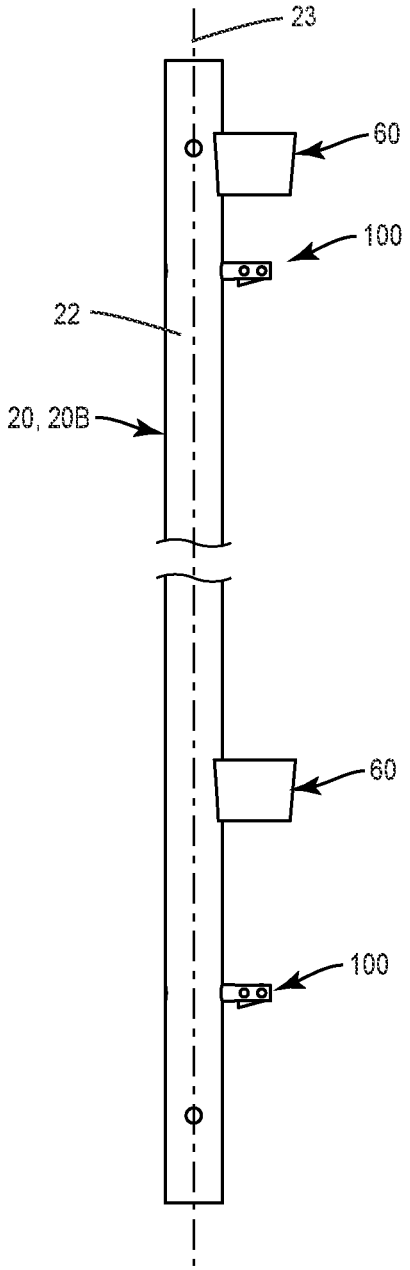
FIGS. 4A and 4B illustrate a vertical support for the ladder frame that does not connect to a ladder rung.
Figure 4B:
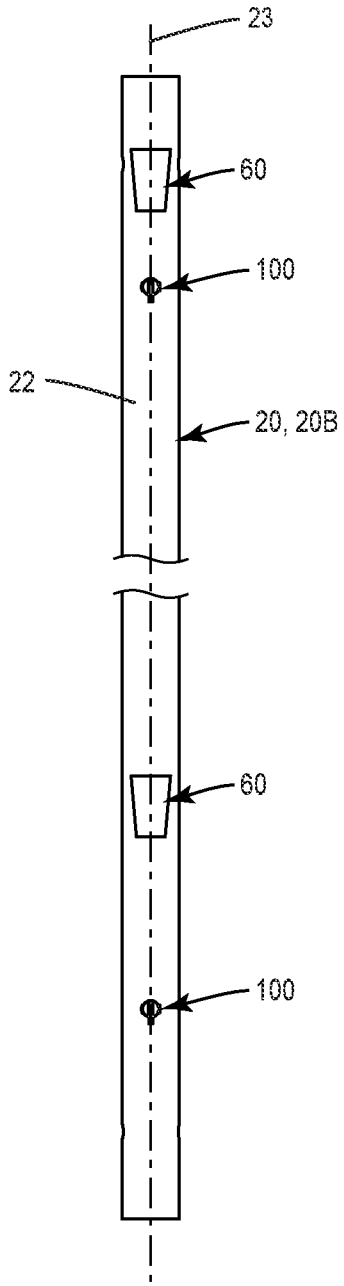

FIGS. 4A and 4B illustrate a second type of vertical support 20 for the ladder frame 12 that does not support the ladder rungs 50. For ease of reference, this vertical support 20 may be referred to as the second vertical support 20B, or sometimes the second outer vertical support 20. The vertical support 20B comprises a generally cylindrical tube 22 made of metal. Two female connectors 60 are welded to the outer surface of the tube 22 and located at points where the horizontal supports 30 connect with the vertical support 20. The female connectors 60 are shown in more detail in FIGS. 10A-10C. Additionally, two latch posts 100 are secured to the tube 22 adjacent the upper and lower ends of the vertical support for engagement by the cross braces 14. The latch posts 100 are shown in more detail in FIGS. 15 and 16.

Figure 5A:
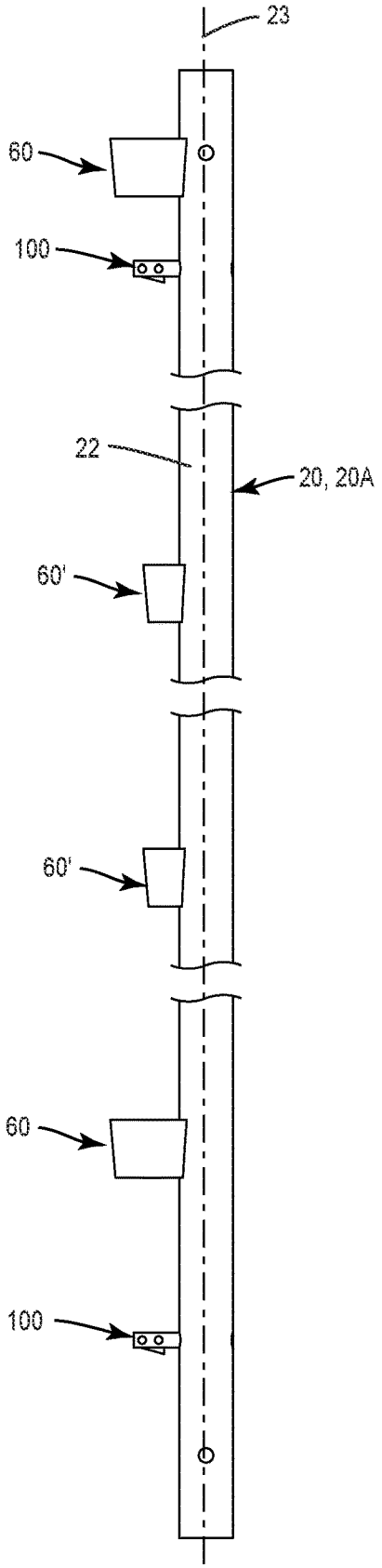
FIGS. 5A and 5B illustrate a vertical support for the ladder frame that connects to a ladder rung.
Figure 5B:
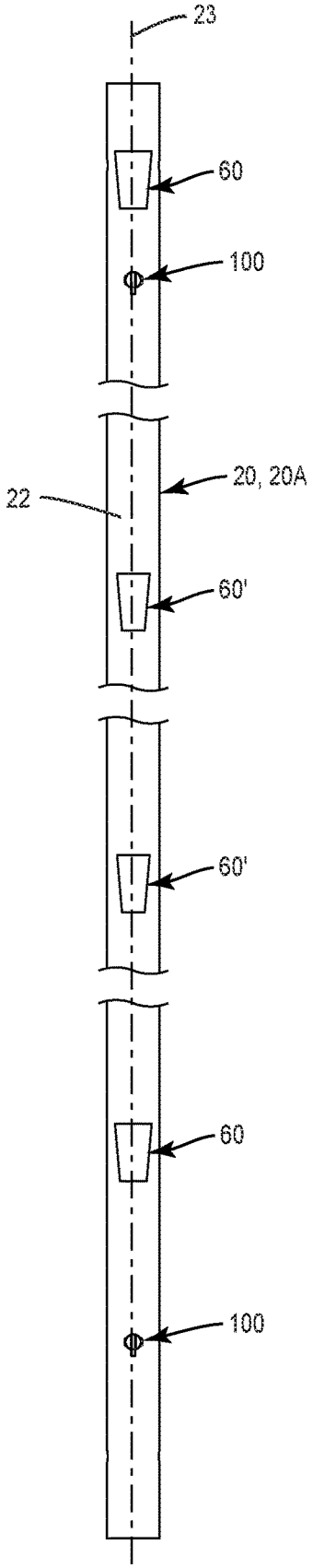

FIGS. 5A and 5B illustrate a first type of vertical support 20 for the ladder frame 12 that supports the ladder rungs 50. For ease of reference, this vertical support 20 may be referred to as the first vertical support 20A, or sometimes the first outer vertical support 20. The first type of vertical support 20A is the same as the second type of vertical support 20 with the addition of two female connectors 60' located at points where the ladder rungs 50 join the vertical support 20A. The female connectors 60' are essentially the same as the female connectors 60 shown in FIGS. 10A-10C but reduced in size.

Figure 6A:
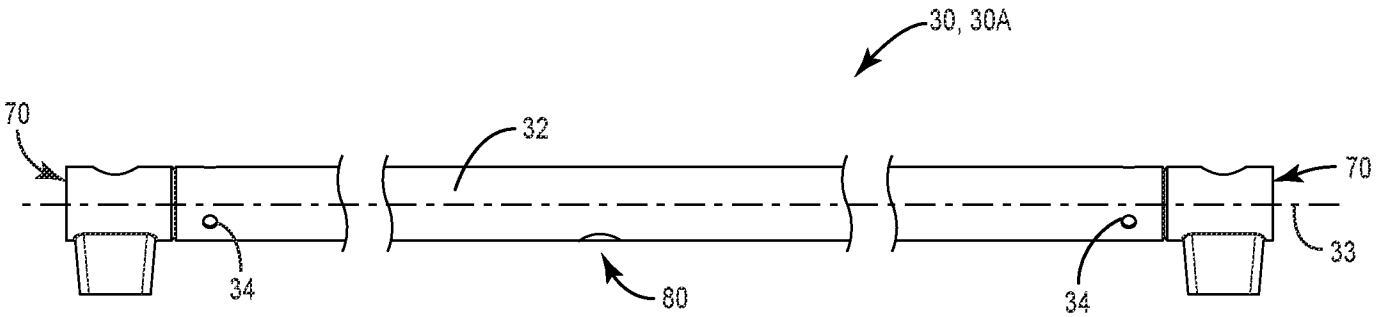
FIGS. 6A and 6B illustrate the upper horizontal support for the frame.
Figure 6B:
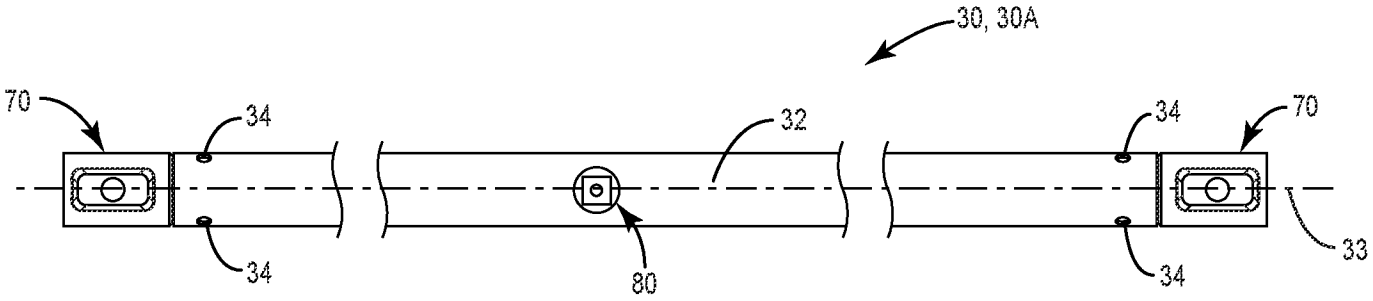

FIGS. 6A and 6B illustrate the upper horizontal support 30A of the frame 12. The upper horizontal support 30A comprises a cylindrical tube 32 made of metal with a male connector 70 at each end thereof for connecting with the vertical supports 20. The male connector 70 is shown in more detail in FIGS. 11A-11D. The tube 32 includes a series of straight openings 34 circumferentially spaced around the tube 32 at each end thereof for spot welding the male connector 70 to the tube 32. A straight female connector 80 is inserted into an opening in the underside of the tube 32 at the location where the center support 40 joins with the upper horizontal support 30A. The straight female connector 80 is shown in FIGS. 12A-12D.

Figure 7A:
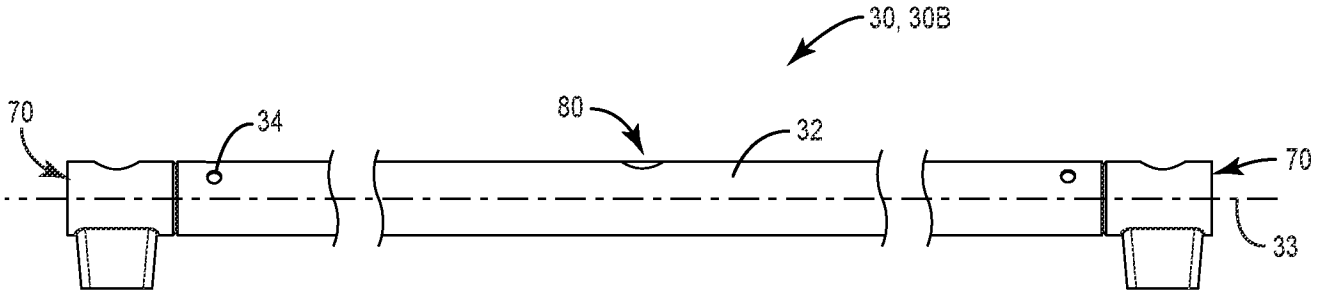
FIGS. 7A and 7B illustrate the lower horizontal support for the frame.
Figure 7B:
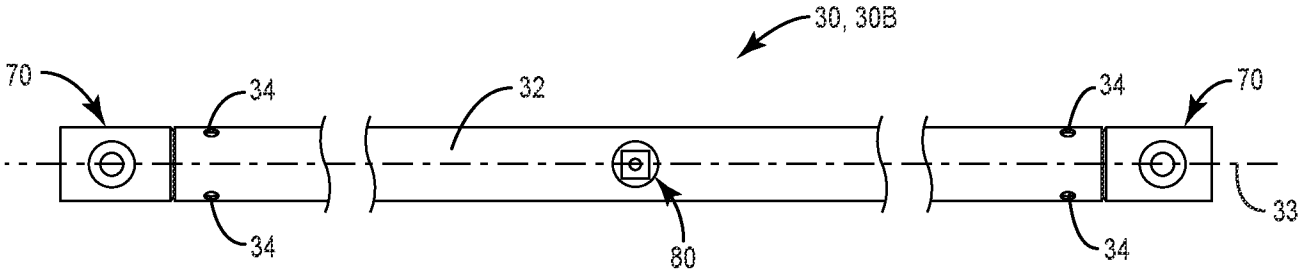

FIGS. 7A and 7B illustrate the lower horizontal support 30B of the frame 12. The lower horizontal support 30B is essentially the same as the upper horizontal support 30A except for the location of the straight female connector 80. The upper horizontal support 30A comprises a cylindrical tube 32 made of metal with a male connector 70 at each end thereof for connecting with the vertical supports 20. The male connector 70 is shown in more detail in FIGS. 11A-11D. The tube 32 includes a series of straight openings 34 circumferentially spaced around the tube 32 at each end thereof for spot welding the male connector 70 to the tube 32. In the lower horizontal support 30B, the straight female connector 80 inserts into an opening in the upper side (as opposed to the lower side) of the tube 32 at the location where the center support 40 joins the lower horizontal support 30B.

Figure 8A:
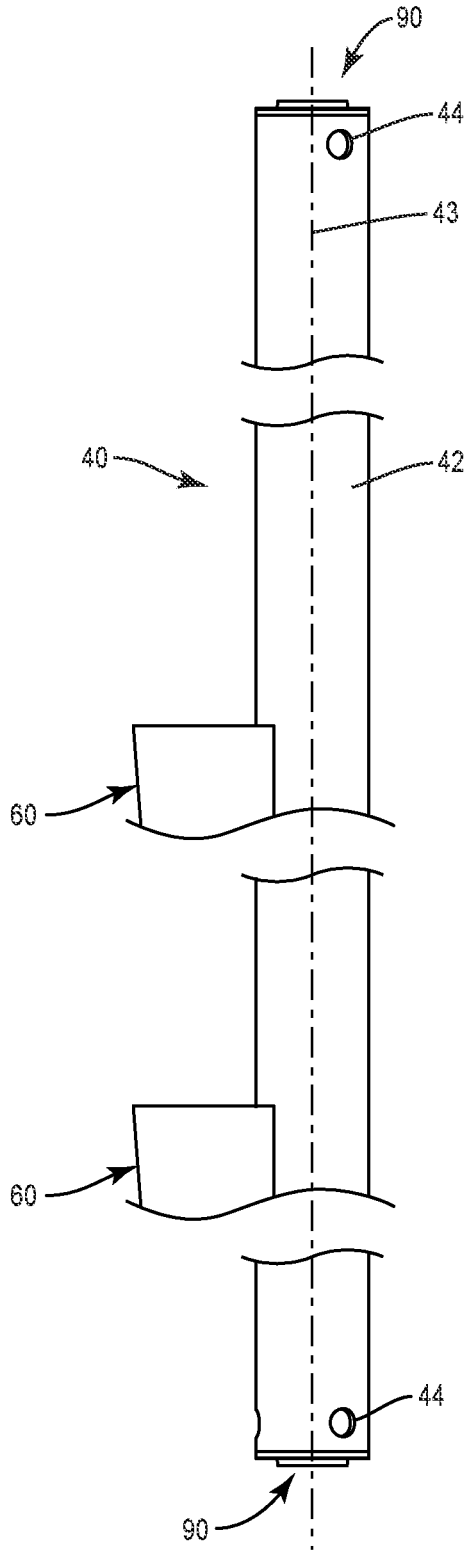
FIGS. 8A and 8B illustrate a center support for the frame.
Figure 8B:
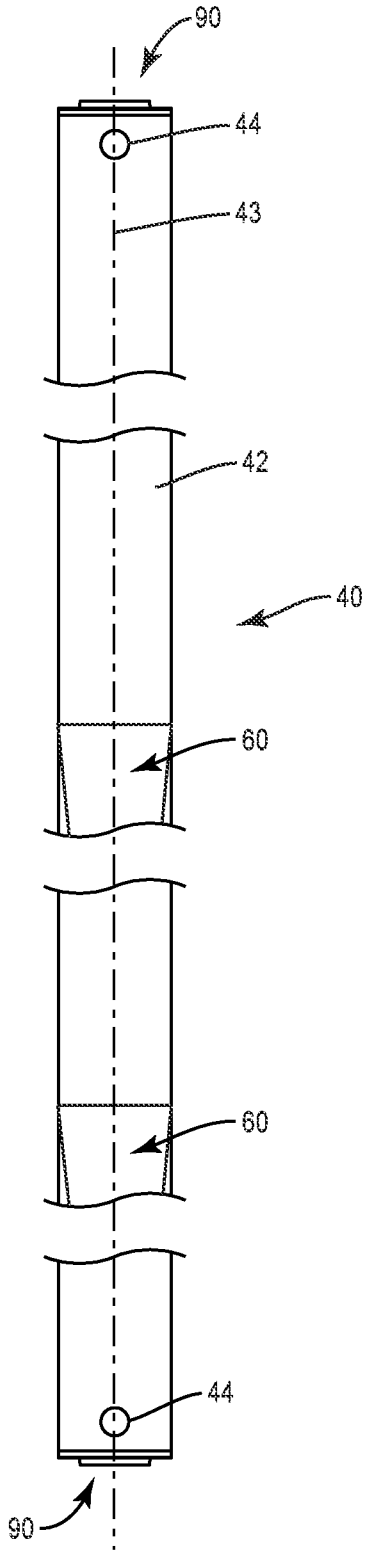
Figure 13A:
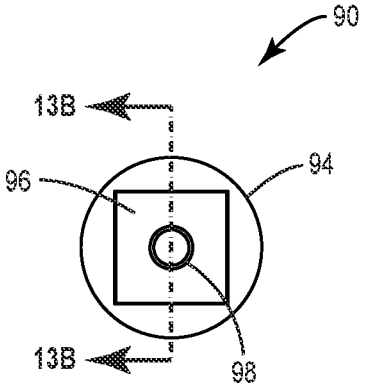
FIGS. 13A-13B illustrate a straight male connector for connecting the center support and ladder rungs.
Figure 13B:
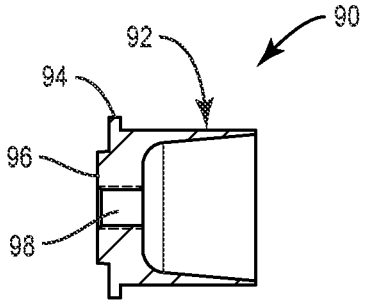

FIGS. 8A and 8B illustrate the center support 40. The center support 40 comprises a cylindrical tube 42 made of metal with a straight male connector 90 at each end thereof for connecting with the horizontal supports 30. The tube 42 includes a series of straight openings 44 circumferentially spaced around the tube 62 at each end thereof for spot welding the straight male connector 90 to the tube 42. The straight male connector 90 is shown in FIGS. 13A-13B. Two female connectors 70 are disposed along the center support 40 at the locations where the ladder rungs 50 connect to the center support 40. The female connectors 80 are shown in FIGS. 12A-12D.

Figure 9:
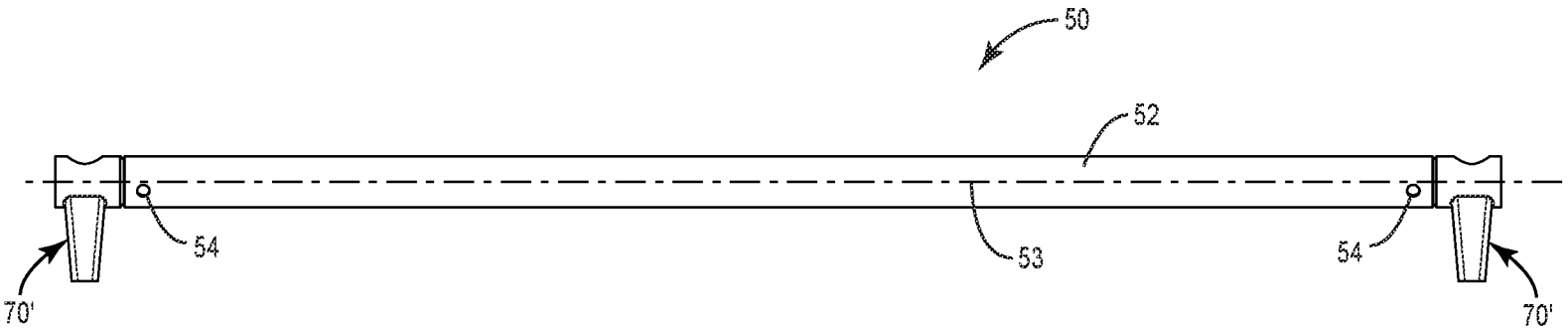
FIG. 9 illustrates an exemplary ladder rung.

FIG. 9 illustrates an exemplary ladder rung 50 for the frame 12. The ladder rung 50 comprises a cylindrical tube 52 made of metal with a male connector 90 at each end thereof for connecting with the center support 40 and vertical support 20A respectively. The tube 52 includes a series of straight openings 54 circumferentially spaced around the tube 52 at each end thereof for spot welding a straight male connector 90 to the tube 42. The straight male connector 90 is shown in FIGS. 13A-13B.

Figure 10B:
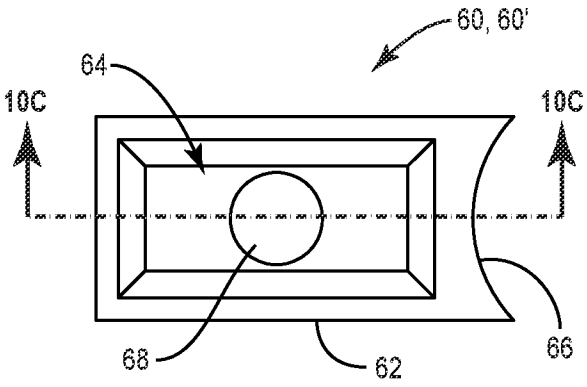
FIGS. 10A-10C illustrate a female connector on the vertical supports that mates with an angled male connector on the horizontal supports.
Figure 10C:
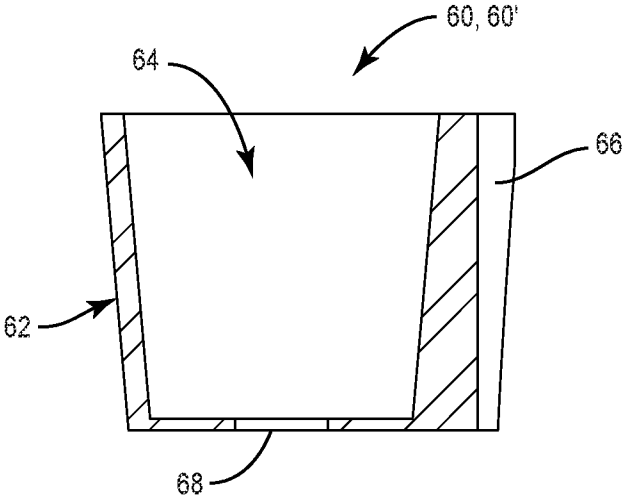
Figure 10A:
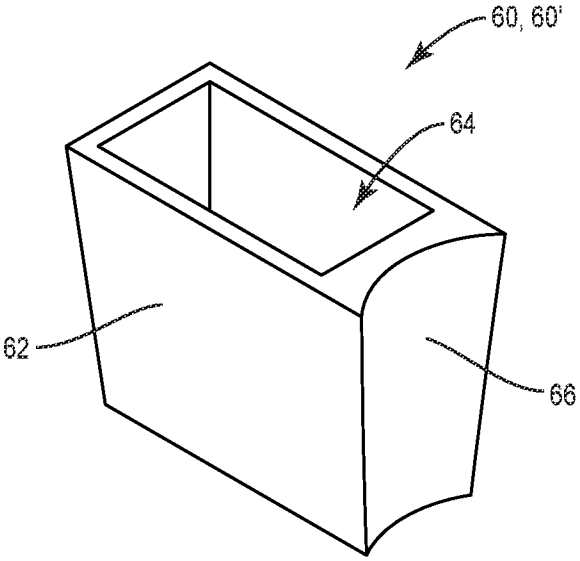
Figure 11A:
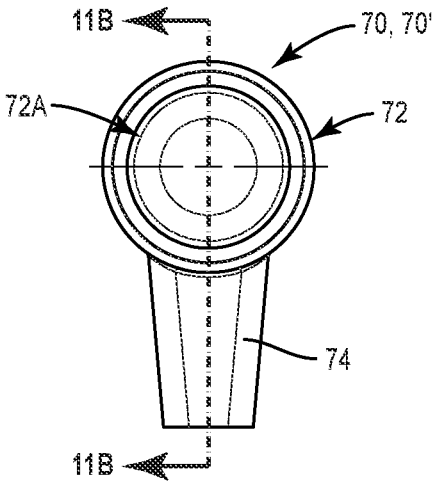
FIGS. 11A-11D illustrate an angled male connector on the horizontal supports that mates with the female connectors on the vertical supports.
Figure 11B:
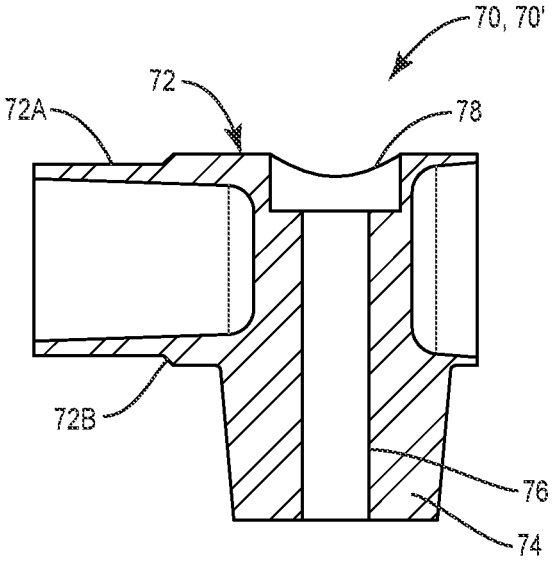
Figure 11C:
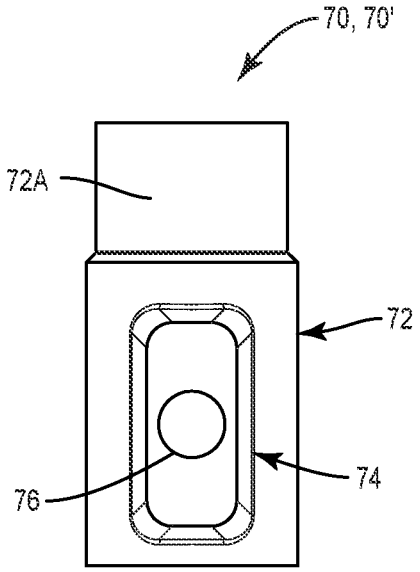
Figure 11D:
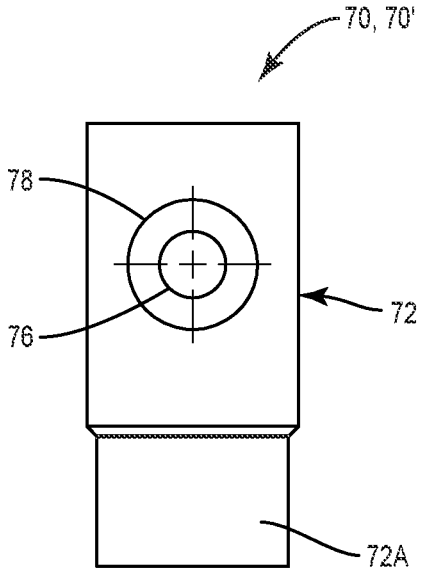
Figure 12A:
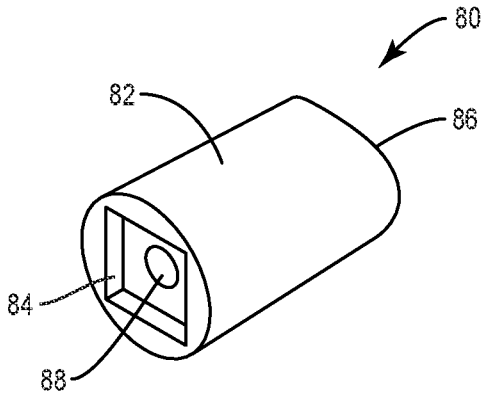
FIGS. 12A-12D illustrate a female connector for connecting the center support and ladder rungs.
Figure 12B:
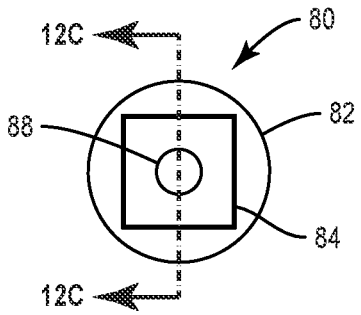
Figure 12C:
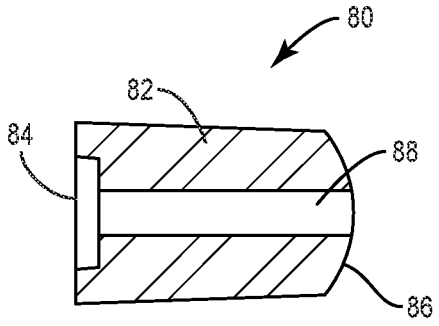
Figure 12D:
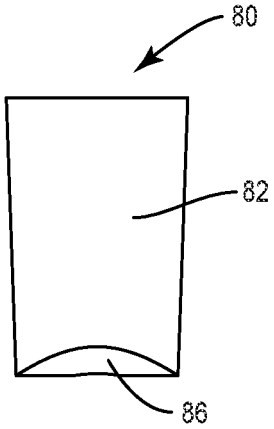

FIGS. 10A-10C illustrates the female connector 60 for connecting the horizontal supports 30 to the vertical supports 20. The female connector 60 comprises a tapered, polygonal sleeve 62 defining a receptacle 64 to receive a similarly formed male connector. The receptacle 64 is in the general form of a rectangular cone with four trapezoidal faces. The receptacle 64 is generally square or rectangular in cross section and is wider at the upper end and smaller at the lower end. One outer surface 66 of the sleeve 62 is curved to conform to the outer radius of the vertical support 20. A hole 68 is formed in the lower end of the female connector 60 to allow a threaded bolt to be inserted through the female connector 60. In a preferred embodiment, the female connector 60 is made of forged steel and is welded to the outer surface of the vertical support 20 with the curved surface 66 in contact with the vertical support 20.

The female connector 60' for connecting the ladder rung 50 to the center support 40 and vertical support 20A is essentially the same as shown in FIGS. 10A-10C but reduced in size. Also, the shape of the receptacle 64 for the female connector 60' may be changed. As one example, the receptacle 64 for the female connector 60' may be a square cone.

FIGS. 11A-11D illustrate the male connector 70 for connecting the horizontal supports 30 to the vertical supports 20. The male connector 70 comprises a metal sleeve 72 with a generally circular cross section that is designed to insert into the ends of the horizontal supports 30. The sleeve 72 includes an open end and a closed end. The open end is reduced in diameter to fit into the end of the horizontal support 30 with shoulder 72B contacting the end of the horizontal support 30. The diameter of the closed end matches the outer diameter of the horizontal support 30 so that walkboards can be placed on top of the connector without disruption.

The male connector 70 further includes a projection 74 extending downward from the closed end of the sleeve 72 at approximately at 90-degree angle. The projection 74 is in the general form of a rectangular cone with four trapezoidal faces. The projection 74 is advantageously generally square or rectangular in cross section and conforms to the shape of the receptacle 64 in the female connector 60. The projection 74 is wider at the upper end and smaller at the lower end. The projection 74 is designed to fit the receptacle 64 in the mating female connector 60 and the edges between the faces of the projection 74 are radiused to allow proper seating in the receptacle 64 of the female connector 60 with surface-to-surface contact between the four faces of the projection and the four faces of the receptacle 64 in the female connector 60. An axial bore 76 extends vertically through the closed end of the sleeve 72 and the projection 74 to allow passage of a threaded bolt 65 that is used to secure the male and female connectors together. A recessed counterbore 78 is formed at the upper end of the axial bore for the head of the threaded bolt 65. The recessed counterbore 78 allows a walkboard/deck to be placed on top of the male connector 70 without interference from the bolt 65.

The male connector 70 is preferably a unitary piece that is forged from steel or other metal. During manufacture, the reduced diameter section of the sleeve 72 is inserted into the end of the horizontal support 30 until shoulder 72B butts the end of the horizontal support 30 and then welded in place by forming a weld that extends all the way around the male connector 70 at the joint between the end of the horizontal support 30 and the male connector 70. Additionally, spot welds can be added at circumferentially spaced locations around the reduced diameter section 72A of the sleeve where the openings 34 are formed in the horizontal support 30.

The angled male connector 70' for connecting the ladder rung 50 to the center support 40 and vertical support 20A is essentially the same as shown in FIGS. 11A-11D but reduced in size. Also, the shape of the projection 74 for the male connector 70' may be changed. As one example, the projection 74 for the angled male connector 70' may be a square cone.

Figure 14:
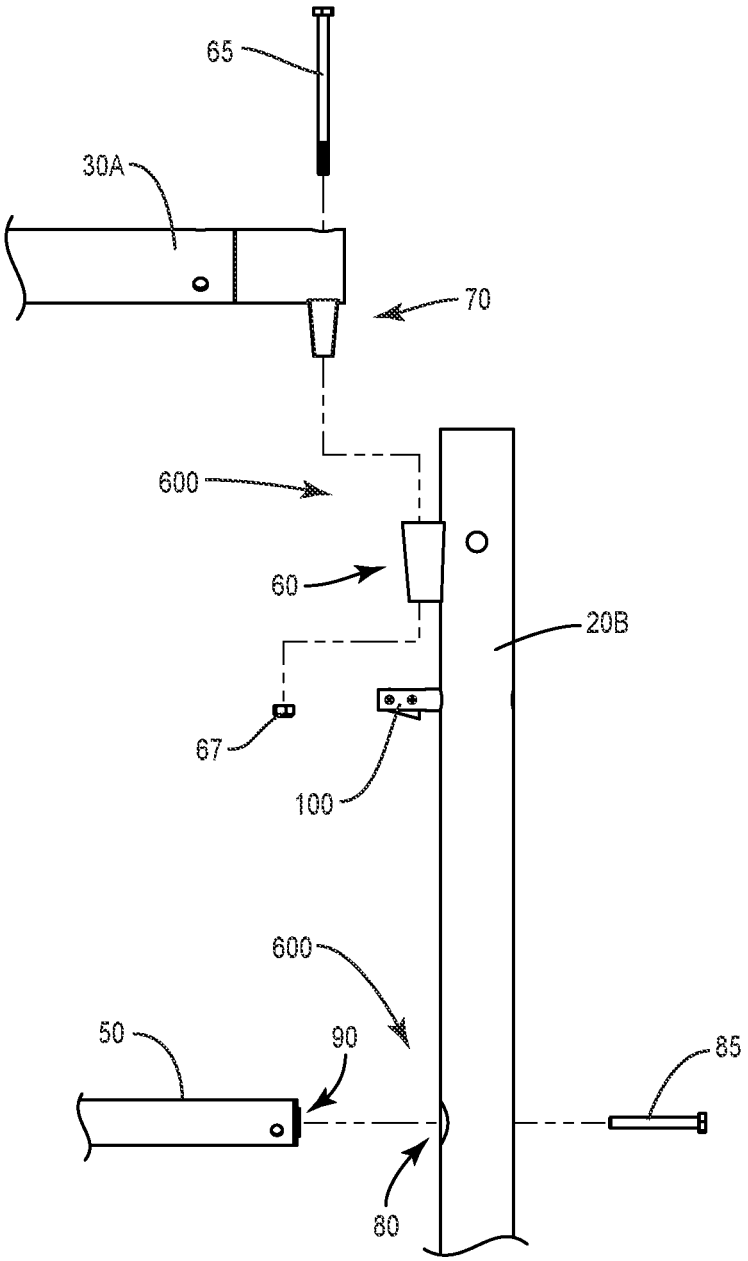
FIG. 14 illustrates interconnections between various components of the ladder frame.

FIG. 14 illustrates how the female connector 60 and male connector 70 mate. As shown in FIG. 14, the horizontal support 30 is lowered into position with the projection 74 of the male connector 70 aligned with the receptacle 64 in the female connector 60 on the vertical support 30. The projection 74 of the male connector 70 is received in the similarly shaped receptacle 64 in the female connector 60. Once the male connector 70 is fully inserted, a threaded bolt 65 is inserted through the axial bore 76 of the male connector 70 and opening 68 in the lower end of the female connector 60. A fastener 67 (e.g., a nut) is threaded onto the lower end of the bolt. When the fastener is tightened, the male connector 70 is pulled downward into the female connector 60 to provide a secure connection. The shape of the male and female connectors prevents relative rotation of the components and provides torsional rigidity to the frame 12.

The female connector 60' and male connector 70' mate in a similar fashion and secured by a threaded bolt 75 and fastener 77.

FIGS. 12A-12D illustrate the straight female connector 80 for connecting the center support 40 to the horizontal supports 30. The same connector may also be used to connect the ladder rung 50 with the center support 40 and vertical support 20A. The straight female connector 80 comprises a generally cylindrical body 82 resembling a plug. The cylindrical body 82 includes a recessed socket 84 in one end. The socket 84 is shaped to receive a compatible male connector 90 as will be hereinafter described. The compatible male connector 90 is shown in FIGS. 13A-13B. The opposite end 86 is curved to conform to the inside radius of the vertical tube support. An axial bore 88 extends through the cylindrical body 82.

In the exemplary embodiment, the socket 84 is in the general form of a square or rectangular cone with four trapezoidal faces. The socket 84 is generally square or rectangular in cross section. The socket 84 is wider at the outer end and smaller at the inner end.

The female connector 80 comprises a unitary piece designed to be inserted into an opening cut into the tube 22 for the vertical support 20 or the tube 42 for the center support 40 with the socket 84 facing out and the curved end 86 in contact with the inner surface of the tube 22, 42. The female connector 80 is secured in place by welding around the perimeter of the female connector 80. Additional spot welds can be added on the opposite side of the tube 22 or the tube 42 where the curved surface contacts the inner surface of the tube 22, 42. The structure of the female connector 80 and the weldment to the tube 22, 42 are designed to maintain the strength and rigidity of the vertical support 20A and center support 40 where the opening is formed to receive the female connector 80. Note that an additional smaller opening is provided in the tube 22 or tube 42, on a side opposite from where the female connector 80 is inserted, for allowing a threaded bolt 85 to be inserted to extend through axial bore 88 in the female connector 80 to engage with male connector 90 as described further below.

When the female connector 80 is joined with a compatible male connector 90, a threaded bolt 85 is inserted through the axial bore 88 in the female connector 80 and threadably engaged with the threaded hole 98 in the male connector 90, so that tightening of the bolt 85 pulls the male connector 90 into intimate contact with the female connector 80.

FIGS. 13A-13B illustrate the male connector 90 that mates with the female connector 80. The male connector 90 includes a sleeve 92 that is closed at one end. A flange 94 projects outward from the sleeve 92 adjacent the closed end. The sleeve 92 is designed to fit into the end of the center support 40 and/or ladder rung 50. The sleeve 92 is pressed into the end of the center support 40 or ladder rung 50 until the flange 94 engages the end of the center support 40 or ladder rung 50. A square or rectangular projection 96 is formed on the closed end of the sleeve 92. The projection 96 is in the general form of a square or rectangular cone with four trapezoidal faces. The projection 96 is generally square or rectangular in cross section and conforms to the shape of the socket 84 in the female connector 80. The projection 96 is wider at the base of the projection 96 and smaller at the outer end. The projection 96 is designed to fit the socket 84 in the mating female connector 80 and the edges between the faces of the projection 96 are radiused to allow proper seating in the socket 84 of the female connector 80 with surface-to-surface contact between the four faces of the projection 96 and the four faces of the socket 84 in the female connector 80. A threaded bore 98 is formed in the closed in of the sleeve 92.

The male connector 90 is preferably a unitary piece that is forged from steel or other metal. During manufacture, the sleeve 92 is inserted into the end of the horizontal support 30 until the flange 94 butts the end of the center support 40 or ladder rung 50 and then welded in place by forming a weld that extends all the way around the male connector 90 at the joint between the end of the center support 40 or ladder rung 50 and the male connector 90. Additionally, spot welds can be added at circumferentially spaced locations around the center support 40 or ladder rung 50 where the openings 44, 54 are formed in the center support 40 or ladder rung 50 respectively.

FIG. 14 also illustrates how the female connector 80 and male connector 90 mate. FIG. 14 shows the ladder rung 50 with a male connector 90 being joined with the female connector 80 in the vertical support 20A as an example. The ladder rung 50 is moved toward the vertical support 20A with the projection 96 of the male connector 90 aligned with the socket 82 in the female connector 80 on the vertical support 20A. The projection 96 of the male connector 90 is received in the similarly shaped socket 82 in the female connector 80. Once the male connector 90 is fully inserted, a threaded bolt is inserted through the vertical support 20A and female connector 80 and threaded into the threaded hole 98 of the male connector 90. Thus, the male connector 90 acts as the nut for the threaded bolt. When the threaded bolt is tightened, the male connector 90 is pulled into the female connector 60 to provide a secure connection. The shape of the male and female connectors prevents relative rotation of the components and provide torsional rigidity to the frame 12. Further, the shape of the female connector 80 prevents crushing of the vertical support 20A. As previously noted, the curved end of the female connector contacts the inner surface of the vertical support 20A as the threaded bolt is tightened so that the wall of the vertical support 20A is not bent inwards when the threaded bolt is tightened.

Figure 25:
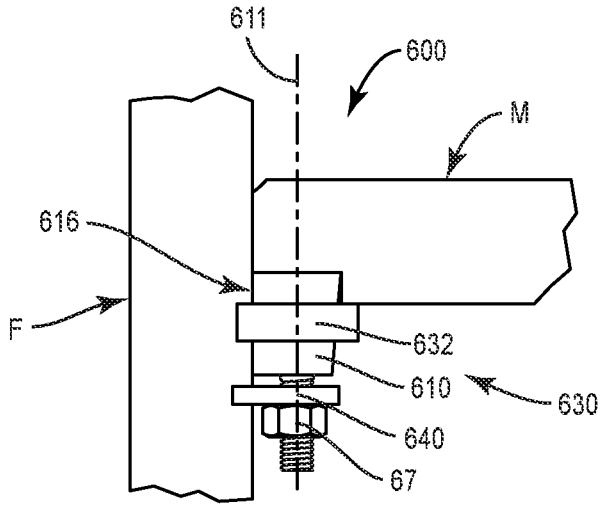
FIG. 25 shows an exemplary releasable connection as used in the scaffold of FIG. 17.
Figure 26:
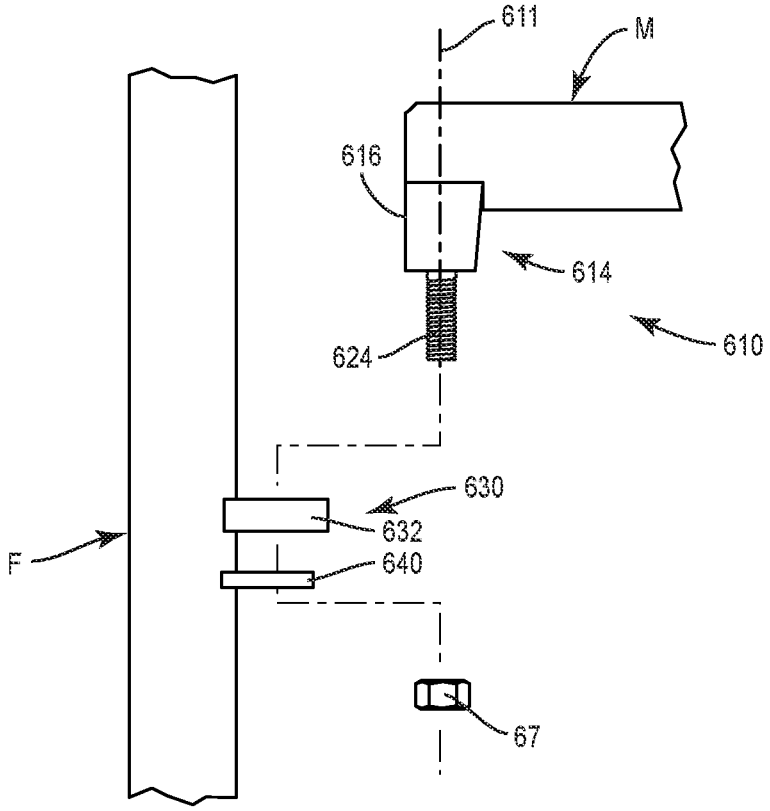
FIG. 26 shows an exploded view of the releasable connection of FIG. 25.
Figure 27:
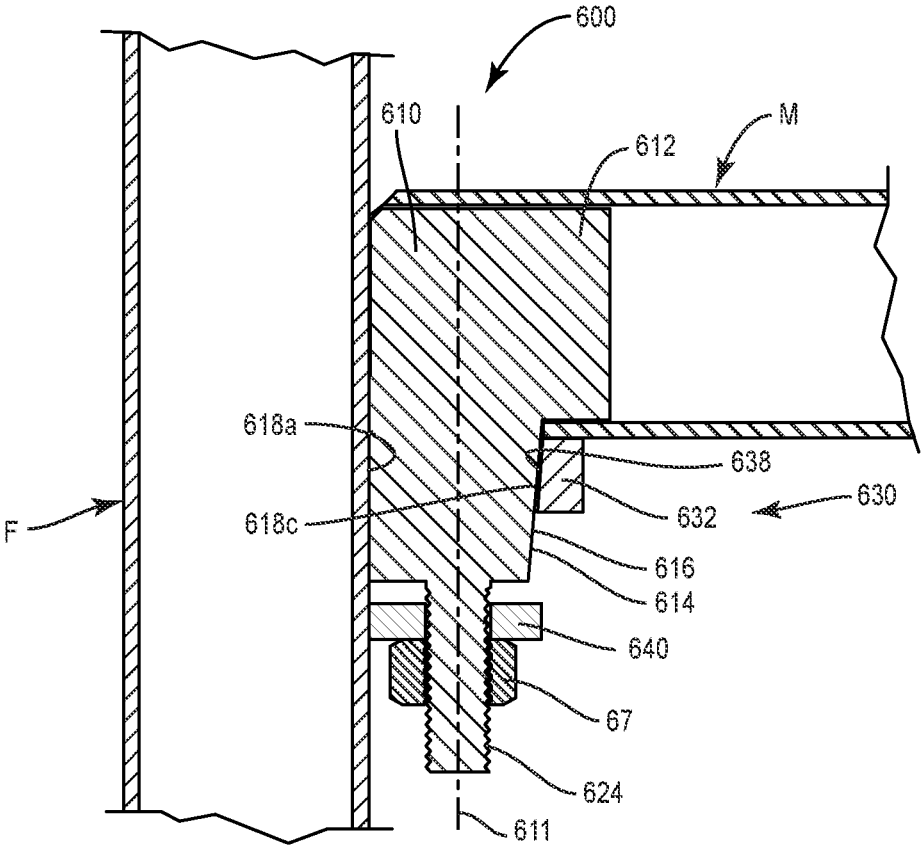
FIG. 27 shows a cross-sectional view of the releasable connection of FIG. 25.

The mating of a male connector 70 or 70' or 90 to a female connector 60 or 60' or 80, optionally with suitable fastener such as fastener 67, forms a releasable connection 600. The releasable connection 600 may take other forms described herein, such as that shown in FIGS. 25-27.

Figure 16:
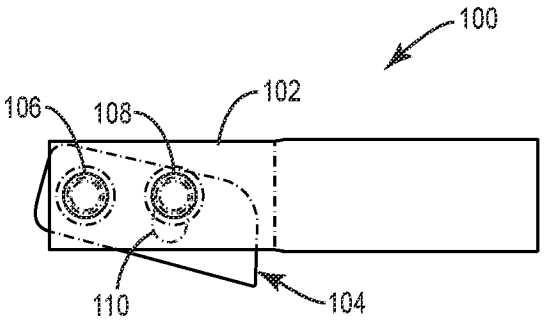
FIGS. 15 and 16 illustrate an exemplary latch post for connecting the cross brace to the vertical supports of the ladder frame.
Figure 15:
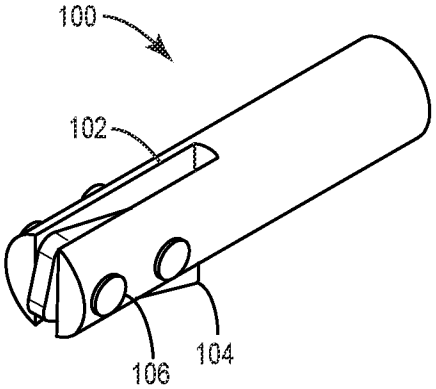
Figure 17:
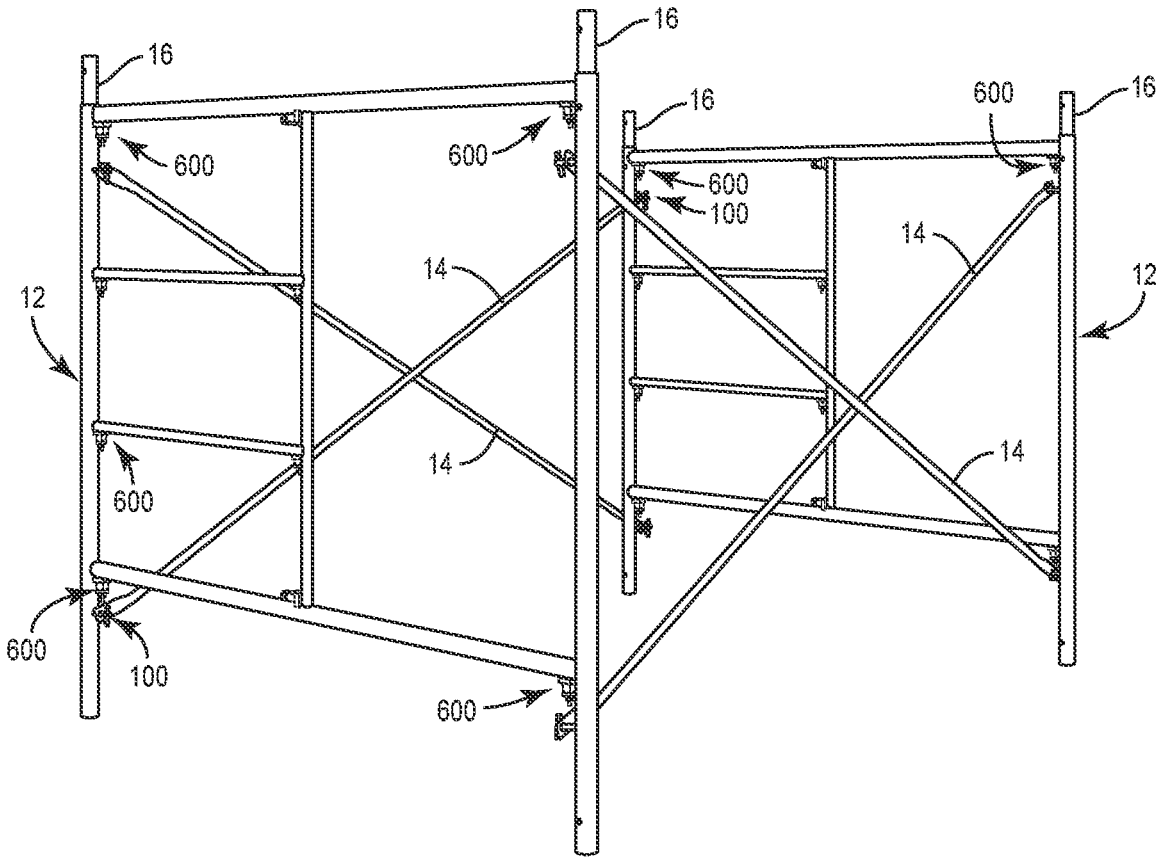
FIG. 17 shows another utility scaffold according to another exemplary embodiment.

FIGS. 15 and 16 illustrate the latch post 100. The latch post 100 includes a slot 102 to receive a locking member 104. The locking member 104 is secured in the slot 102 by a pivot pin 106 disposed at the outer end of the latch post 100. A second pin 108 is received in a slot 110 in the locking member 104. This arrangement allows the locking member 104 to drop down under the force of gravity and thus serve as a latch as to retain the cross brace 14 on the latch post 100.

During assembly of the scaffold 10, the cross braces 14 engage with the latch posts 100 on the frames 12 of the scaffold. The cross braces 14 optionally have flattened ends with openings formed therein. The openings in the ends of the cross braces 14 will pass over the latch posts 100 and push the locking member 104 upwardly. Once the opening in the cross brace 14 passes over the locking member 104, the locking member 104 will drop down under the force of gravity to latch the cross brace 14 and prevent it from disengaging.

While the exemplary embodiments of the interfaces of the female connectors 60 and 80 with the male connectors 70 and 90 have generally square or rectangular configurations, those skilled in the art will appreciate that other geometries could be used. Examples of other polygonal shapes include triangles, pentagons, trapezoids, hexagons, and octagons. Also, elliptical or oval configurations that are resistant to rotation could be also used. In other embodiments, the interfaces of the connectors may have a circular cross section and complementary splines and grooves can be used to prevent relative rotation. In general, the interface between the female connectors 60 and 80 with the male connectors 70 and 90 can use any geometry that prevent relative rotation between the female connectors 60 and 80 with the male connectors 70 and 90.

In the illustrated embodiment, the angled connectors 60, 70 are used for joining the horizontal supports 30 to the vertical supports 20. An advantage of the angled connectors 60, 70 is that the weight applied during use pushes the male connector 70 into the female connector 60 and provides a failsafe. In some embodiments, the angled connectors 60, 70 for connecting the horizontal supports 30 to the vertical supports 20 can be replaced with straight connectors similar to the connectors 80, 90 shown in FIGS. 12 and 13. In this case, the length of the projection 96 and depth of the socket 84 might be increased to provide a more secure connection capable of holding the expected loads without separating.

In some embodiments, the angled connectors 60', 70' for connecting the ladder rungs 50 to the center support 40 and vertical support 20B can be replaced with straight connectors similar to the connectors 80, 90 shown in FIGS. 12 and 13. The straight connectors for the ladder rungs 50 would be a smaller version of the connector 80, 90 for the center support 40, scaled to the dimensions of the ladder rungs 50. An advantage of the angled connectors for the ladder rungs 50 is that the weight applied to the ladder rungs 50 during use would push the male connector into the female connector and provide a failsafe.

In general, any connection between the individual components of the ladder frame 12 can use either a straight connector or angled connector. Straight connectors can be used for all connections. Similarly, angled connectors could be used for all connections. Moreover, any combination of straight connectors and angled connectors can be used.

Figure 18:
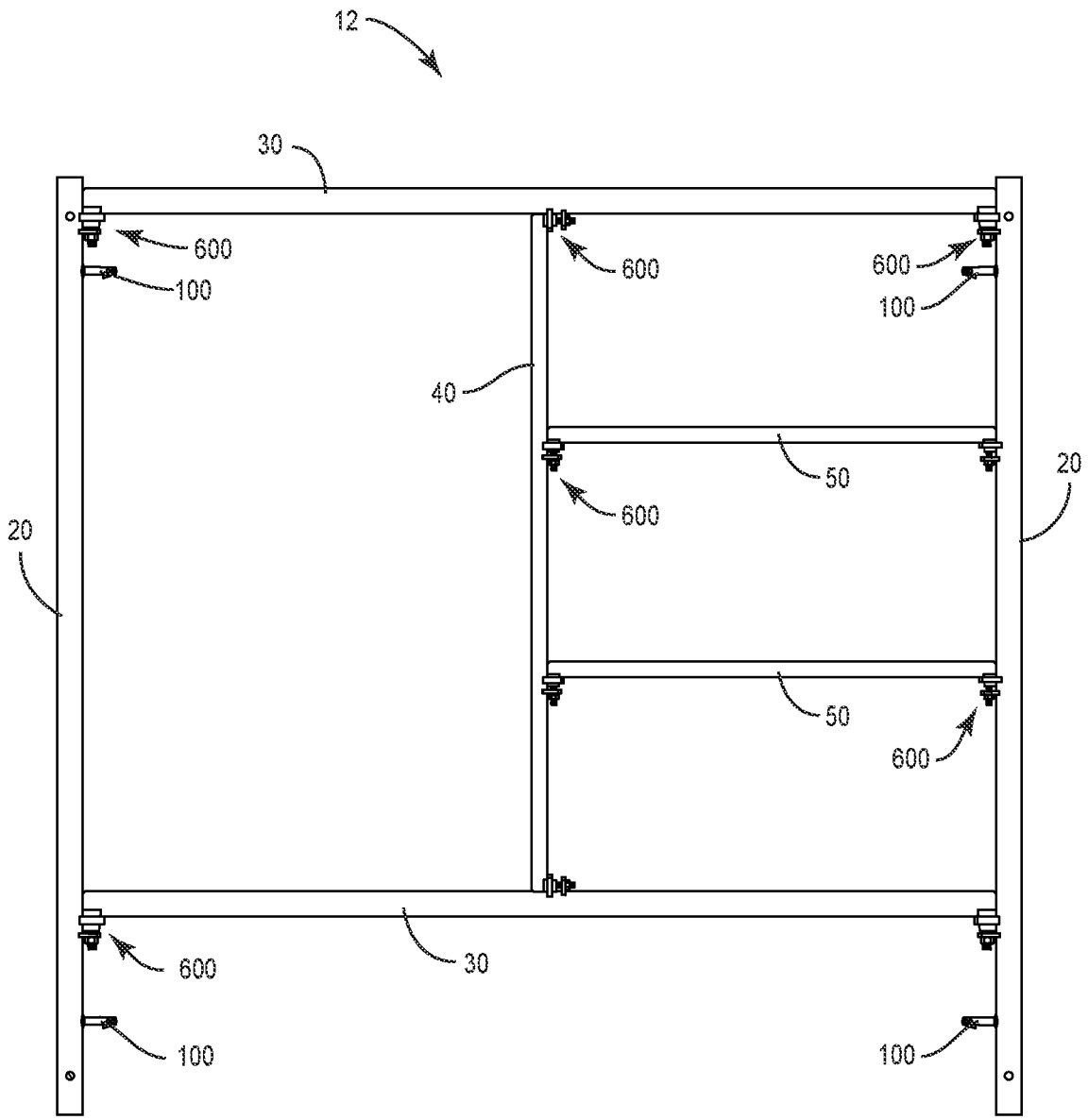
FIG. 18 shows an exemplary ladder frame as used in the scaffold of FIG. 17.
Figure 19:
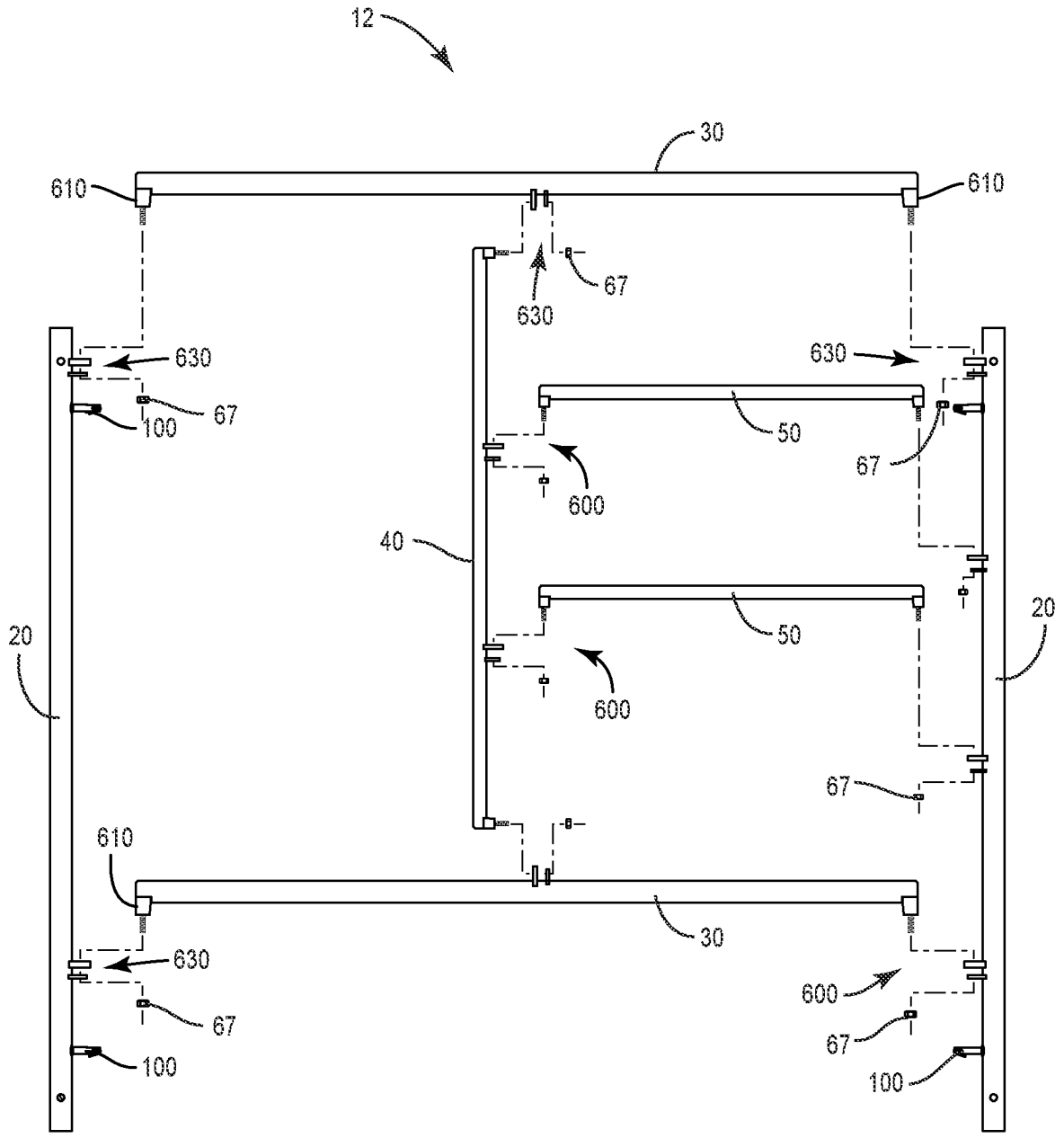
FIG. 19 shows an exploded view of the ladder frame of FIG. 18.

Another embodiment of scaffold 10 is shown in FIGS. 17-30. The scaffold 10, like the scaffold 10 in FIGS. 1-16, includes a first ladder frame 12, a second ladder frame 12, and a plurality of cross braces 14. The ladder frames 12, as shown in FIG. 18, include a plurality of vertical supports 20 (or "posts") and a plurality of horizontal supports 30 (or "rails"). The first and second ladder frames 12 are configured to be repeatedly changeable between an assembled state and a disassembled state. In the assembled state, the horizontal supports 30 are mounted to the vertical supports 20 via a plurality of releasable connections 600 to form a rigid structure. In the disassembled state, the horizontal supports 30 and the vertical supports 20 are dismounted from each other to facilitate storage and/or transport.

Figure 20:
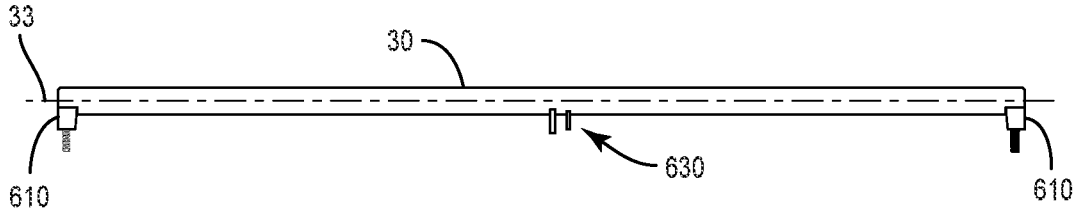
FIG. 20 shows an exemplary horizontal support as used in the scaffold of FIG. 17.
Figure 21:
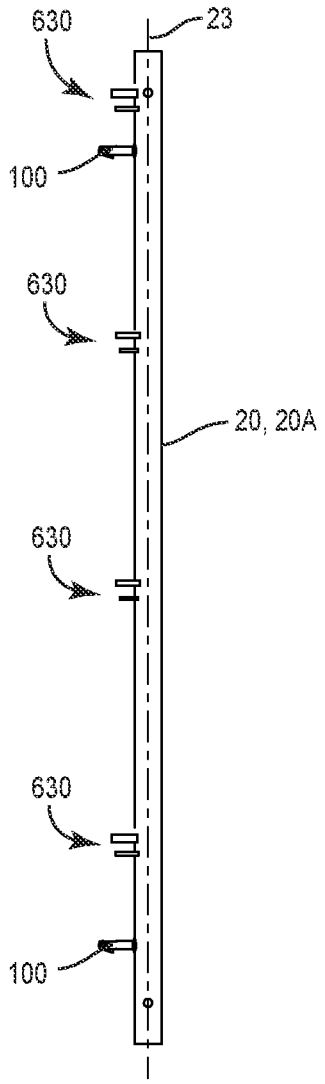
FIG. 21 shows an exemplary first outer vertical support as used in the scaffold of FIG. 17.
Figure 22:
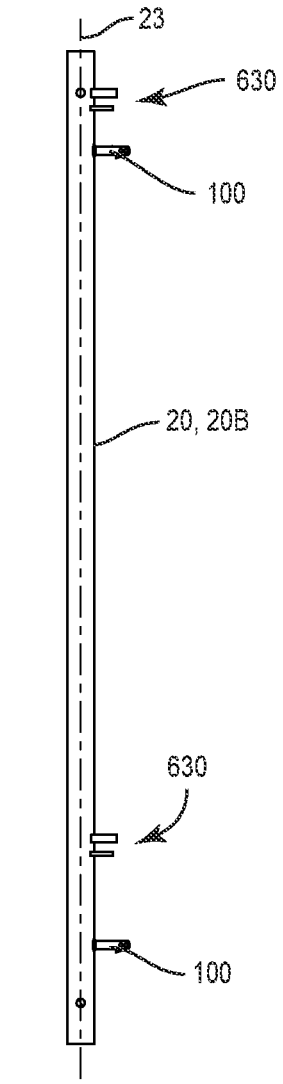
FIG. 22 shows an exemplary second outer vertical support as used in the scaffold of FIG. 17.
Figure 23:
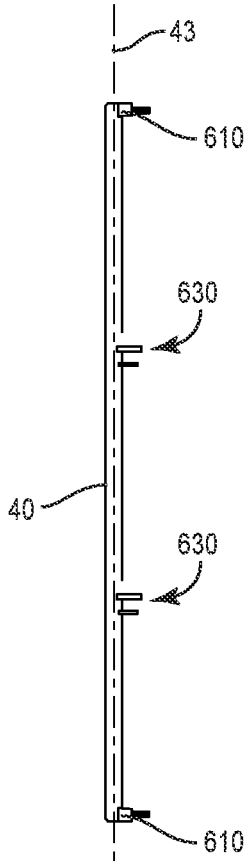
FIG. 23 shows an exemplary center support as used in the scaffold of FIG. 17.
Figure 24:
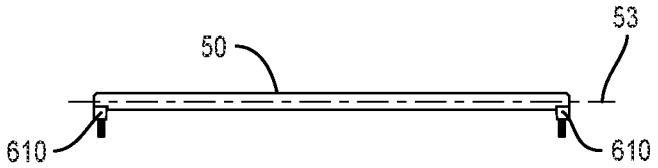
FIG. 24 shows an exemplary rung as used in the scaffold of FIG. 17.

The horizontal supports 30, vertical supports 20, rungs 50, center support 40, and cross braces 14 are substantially as described above with respect to FIGS. 1-16, but differ primarily in the form of the releasable connections 600 used. Briefly, an exemplary horizontal support 30 is shown in FIG. 20. The horizontal support 30 includes a tube 32 that extends along a longitudinal axis 33. A male portion 610 of a releasable connection 600 is affixed to each end of the horizontal support 30, and a female portion 630 of a releasable connection 600 is attached in a central area, for mounting the center support 40. An exemplary first outer vertical support 20 is shown in FIG. 21. The first outer vertical support 20 includes a tube 22 that extends along a longitudinal axis 23. Four female portions 630 of a releasable connection 600, and two latch posts 100 are located as shown. The first outer vertical support 630 is intended for use on the side of the ladder frame 12 where the rungs 50 of the "ladder" portion are located, as illustrated in FIG. 18. An exemplary second outer vertical support 20 is shown in FIG. 22. The second outer vertical support 20 includes a tube 22 that extends along a longitudinal axis 23. Two female portions 630 of a releasable connection 600, and two latch posts 100 are located as shown. The second outer vertical support 20 is intended for use on the side of the ladder frame 12 generally opposite where the rungs 50 of the "ladder" portion are located, as illustrated in FIG. 18. An exemplary center support 40 is shown in FIG. 23. The center support 40 includes a tube 42 that extends along a longitudinal axis 43. A male portion 610 of a releasable connection 600 is affixed to each end of the center support 40, and two female portions 630 of a releasable connection 600 are located at intermediate positions for mounting the rungs 50. The center support 40 is intended to be located between the first and second outer vertical supports 20, advantageously at approximately a midpoint therebetween. An exemplary rung 50 is shown in FIG. 24. The rung 50 includes a tube 52 that extends along a longitudinal axis 53. A male portion 610 of a releasable connection 600 is affixed to each end of the rung 50, for mounting the rung 50 to the center support 40 and the first outer vertical support 20.

Figure 28A:
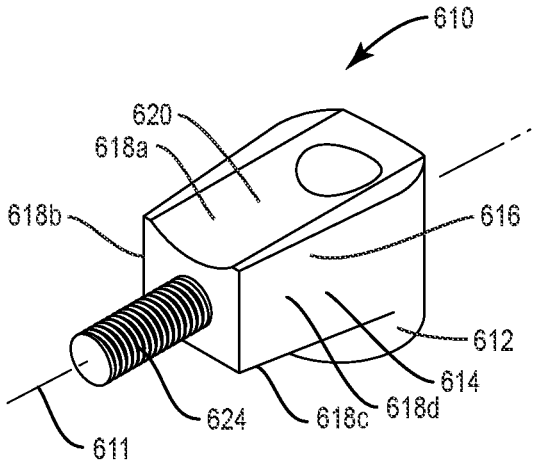
FIGS. 28A-28C show a male portion of the releasable connection of FIG. 25.
Figure 28B:
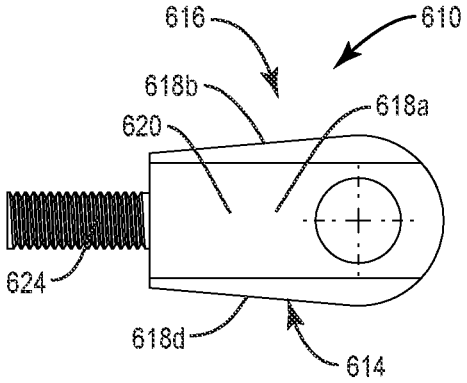
Figure 28C:
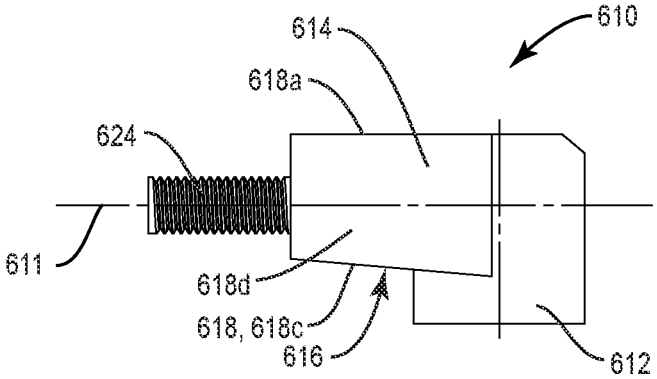

Releasable connections 600 are used to mount the various supports 20,30 and rungs 50 together, such as to mount horizontal supports 30 to the vertical supports 20 to form a rigid structure of a ladder frame 12. In general, the releasable connections 600 of FIGS. 17-30 include a male portion 610 and a female portion 630, and optionally a fastener 67. An example of such a releasable connection 600 is shown in FIGS. 25-30. The male portion 610 is mounted to one of the two elements (e.g., support 20,30 or rung 50) being joined together and the female portion 630 is mounted to the other of the two elements being joined together. For purposes of the following discussion, the element that has the male portion 610 of the releasable connection 600 associated therewith may be referred to as part M, while the element that has the female portion 630 of the releasable connection 600 associated therewith may be referred to as part F. The male portion 610, as shown in FIGS. 28A-28C, has a mounting portion 612 for being permanently mounted to part M. This mounting portion 612 has a shape to allow the mounting portion 612 to be inserted into part M. The male portion 610 also includes a protrusion 614 that extends generally transverse to the mounting portion 612 and along an insertion axis 611. The protrusion 614 is at least partially wedge shaped. Thus, the protrusion 614 of male portion 610 may be referred to as a male wedge protrusion 614. The protrusion 614 of male wedge portion 610 includes a unthreaded portion 616 (exteriorly unthreaded) and a threaded tip portion 624 (exteriorly threaded). The unthreaded portion 616 is non-symmetrical about the insertion axis 611, and is larger in cross-section in its upper part than in its lower part. Advantageously, the unthreaded portion 610 has a faceted cross-section, such as having a square or otherwise rectangular cross-section, or a splined cross-section. In alternative embodiments, the unthreaded portion has a cross-section that is wholly or partially unfaceted (e.g., curvate in any suitable shape, including wavy), but that is non-round. In FIGS. 28A-28C, the unthreaded portion 616 has a wedge portion with a partially faceted cross-section having four bearing surfaces 618: one 618*a* parallel with the insertion axis 611, with the opposite bearing surface 618*c* being angled with respect to the insertion axis 611; and two side bearing surfaces 618*b*, 618*d* that are both angled with respect to the insertion axis 611. In addition, a groove 620 extends along the parallel surface 618*a*, and is configured to receive the outer surface of part F. The threaded portion 624 extends from the untreaded portion along the insertion axis 611. The threaded portion 624 is advantageously permanently affixed to the unthreaded portion 616, such as by being integrally formed with the unthreaded portion 616.

Figure 29A:
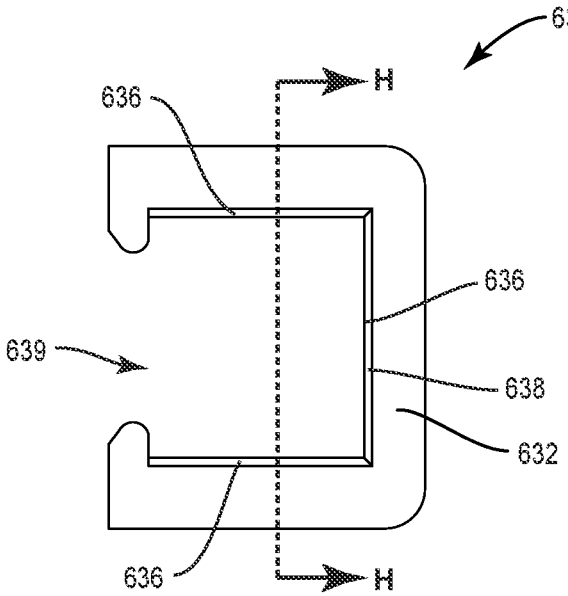
FIGS. 29A-29C show a flange of a female portion of the releasable connection of FIG. 25.
Figure 29B:
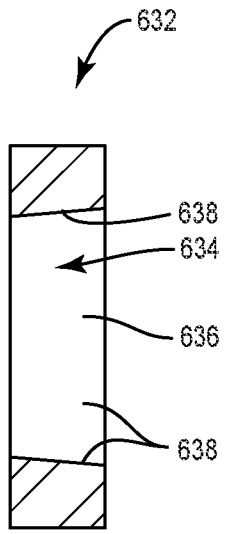
Figure 29C:
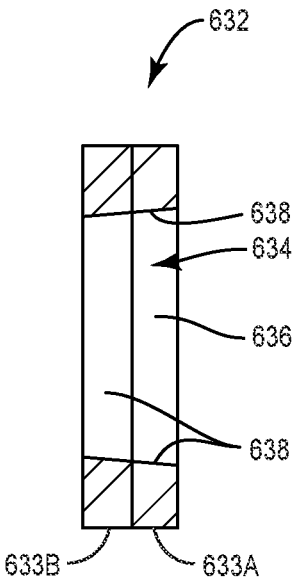
Figure 30A:
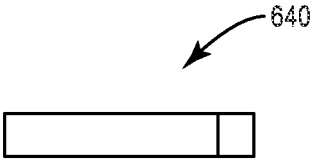
FIGS. 30A-30B show an anchor flange of a female portion of the releasable connection of FIG. 25.
Figure 30B:
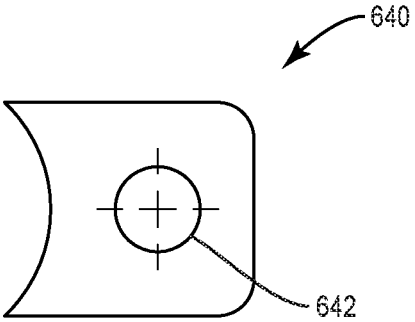
Figure 31:
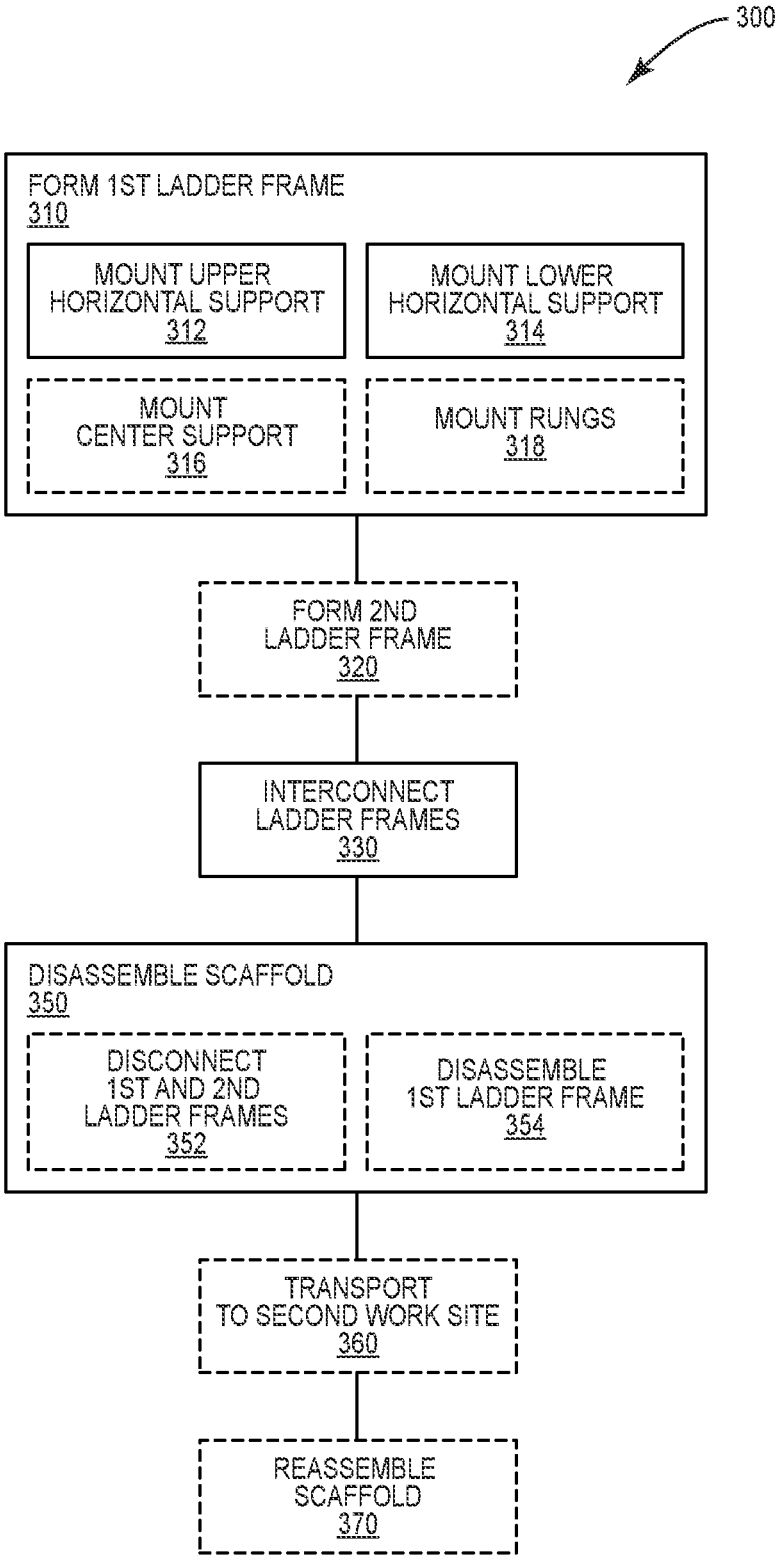
FIG. 31 shows an process flowchart for one or more processes of using one or more of the scaffolds described herein.

The female portion 630 of the releasable connection 600 includes one or more female receivers 632 that are permanently mounted to part F. In some embodiments, the female receiver 632 takes the form of a female flange 632 that is mounted to part F so as to extend generally perpendicular to the longitudinal axis of part F. Thus, flange 632 extends to the side of part F. As shown inf FIGS. 29A-29B, flange 632 includes a passage 634, generally aligned parallel to the longitudinal axis of part F, that extends through the flange 632. An interior wall 636 wholly or partially bounds/forms passage 634 is tapered such that the passage 634 is larger in its upper portion than in its lower portion, and forms at least one bearing surface 638. The passage 634 may be tapered on all sides of the passage 634, or only on one or more sides. For the flange 632 in FIGS. 29A-29B, the passage 634 is tapered on three sides. The angle of the taper may be any suitable amount, such as approximately five to ten degrees, and may be different on different faces. The shape and size of the passage 634 corresponds to the unthreaded portion 616 of protrusion 614. It is intended that the unthreaded portion 616 of protrusion 614 will seat in the passage 634, with one or more bearing surfaces 618 of the protrusion 614 abutting corresponding bearing surfaces 638 in flange 632 bordering the passage 634. As mentioned, the flange 632 is permanently affixed to part F. To facilitate this with minimal space consumption, the flange 632 in FIGS. 29A-29B includes a lateral opening 639 that is configured to receive a portion of the outer surface of part F. The flange 632 may be integral with or affixed to part F by any suitable means, such as by welding. In some embodiments, a single female receiver 632 in the form a flange 632 is used for each releasable connection 600, and the flange 632 is formed as a single unitary body. See, e.g., FIG. 29B. In other embodiments, such as where greater depth is required for passage 634 for enhanced rigidity, the female receiver 632 may be formed of two or more layers that are welded or otherwise affixed to each other. An example of a multi-layer flange 632 is shown in FIG. 29C, with the top view being as shown in FIG. 29A. The multi-layer flange 632 of FIG. 29C has a first layer 633A with a larger opening for passage 634 that smoothly tapers into the corresponding opening in the second layer 633B, such that the passage 634 has a continuous taper. The layers 633A, 633B may be formed separately using a suitable process, such as laser cutting or other processes known in the metal forming art, and then joined together in alignment and welded or otherwise bonded together. The multi-layer flange 632 thus functions as a single body, with a functionally consistent passage 634 and interior wall 636 and bearing face(s) 638. The use of the multi-layer approach for flange 632 may allow for greater depth in passage 634 while allowing cost-effective manufacturing processes to be employed. In some embodiments (not shown), two of more female flanges 632 may be used for each releasable connection 600, with the female flanges longitudinally spaced from each other along part F, In some embodiments, the female portion 630 of releasable connection 600 further includes an anchor flange 640 that is also affixed to part F in spaced relation to flange 632. The anchor flange 640 may take any suitable form, such as a simple plate, advantageously with a contoured side for abutment with part F, as shown in FIGS. 30A-30B. The anchor flange 640 includes a through hole 642 for allowing threaded portion of protrusion 614 to pass through anchor flange 640, for engagement with a suitable fastener 67 (e.g., nut).

The releasable connection 600 is used to mount part M to part F. For purposes of illustration, the upper horizontal support 30 will be used as part M, while the first outer vertical support 20 will be used as part F. The upper horizontal support 30 is brought into position relative to the first outer vertical support 20 so that protrusion 614 is aligned with flange 632, with insertion axis 611 of protrusion 614 aligned to pass through passage 634 of flange 632. The upper horizontal support 30 is then lowered so that protrusion 614 rests inside flange 632, with the unthreaded portion 616 of male wedge protrusion 614 resting against the tapered interior wall 636 of flange 632. The threaded tip portion 624 of protrusion 614 extends outward (downward in this situation) from the flange 632 through the hole 68 formed at or by lower end of passage 634 so as to be exposed. For embodiments that include optional anchor flange 640, the threaded tip portion extends through hole 642 in anchor flange 640 so as to be exposed. A fastener 67 is then threadably engaged with threaded tip portion 624, and tightened to force the unthreaded portion 616 firmly against the interior wall 636 of flange 632. In some embodiments, the fastener 67 is tightened against the underside of flange 632 or against a washer or like that bears against the underside of the flange 632. In other embodiments, the fastener 67 is tightened against the underside of anchor flange 640 or against a washer or like that bears against the underside of anchor flange 640. The tightening of the fastener "pulls" the protrusion 614, and thus the male portion 610 of the releasable connection 600, and thus the upper horizontal support 30, "down" toward the female portion 630 of the releasable connection 600, and thus the first outer vertical support 20. Note that because the cross-sectional shapes of the unthreaded portion 616 of the protrusion 614 and the interior wall 636 of flange 632 bounding the passage 634, the firm engagement of the protrusion 614 and the flange 632 not only prevents the upper horizontal support 30 from moving vertically relative to the first outer vertical support 20, but also inhibits the upper horizontal support 30 from rotating relative to the longitudinal axis 23 of the first outer vertical support 20. Thus, the releasable connection 600 helps forms a solid connection 600 that inhibits relative motion for multiple degrees of freedom.

All the releasable connections 600 of a particular ladder frame 12 and/or scaffold 10 may be of the same type and size, or may any suitable mixture of types and/or sizes. For example, the releasable connections 600 between the upper and lower horizontal supports 30 and the first and second outer vertical supports 20 may be of a type having anchor flanges 640, be a relatively "large" size, and be vertically oriented (insertion direction is vertical); with the releasable connections 600 between the rungs 50 and the center support 40 or first outer vertical support 20 being of a type having anchor flanges 640, be a relatively "medium" size, and be vertically oriented; and with the releasable connections 600 between the center support 40 and the upper and lower horizontal supports 30 being of a type having anchor flanges 640, be "medium" size, and be oriented horizontally rather than vertically. As a further example, some of the releasable connections 600 may be of the type(s) shown in FIGS. 17-30B, while others of the releasable connections 600 may be of the type(s) shown in FIGS. 1-16; and/or the components of the releasable connections 600 described herein may be intermixed as is appropriate (e.g., the flange 632 and optional flange 640 may be used with the male portion 70 and threaded bolt 65 and fastener 67). Accordingly, the male protrusion 614 of male portion 610 of the releasable connection 600 may take a variety of forms, such as the illustrated versions associated with male portions 70, 70', 90, 610; and the female portion 630 of the releasable connection 600 may a female receiver 632 that may take a variety of forms, such as female flange 632 (with or without anchor flange 640) or the other illustrated versions associated with female portions 60, 60', 80, 630.

The various components of the scaffold 10 are formed of suitable material(s), such as steel, which may be heat treated or otherwise processed for sufficient strength. The components may be formed in any suitable method, including at least partially by welding and/or casting. For example, the male portion 610 may be formed by casting with an embedded threaded rod portion, or may be machined from suitable block stock, so that unthreaded portion 616 is integrally formed with threaded portion 624. Further, in one exemplary embodiment, the ladder frames 12 are approximately five feet wide (measured parallel to horizontal supports 30), and approximately five feet tall (measured parallel to vertical supports 20), with the ladder frames 12 being approximately seven feet apart.

Figure 32:
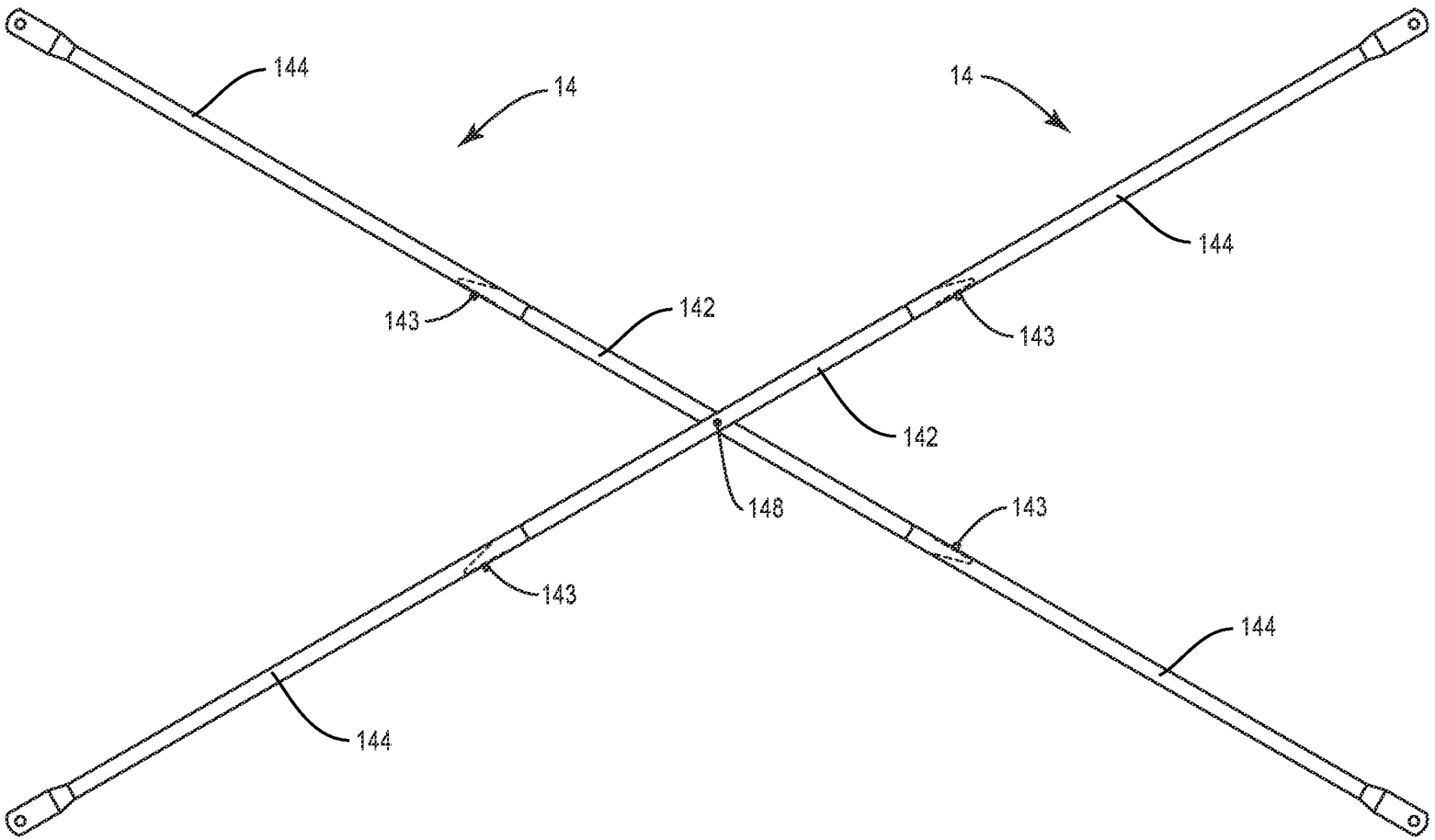
FIG. 32 shows an exemplary pair of cross braces suitable for use in the scaffold of FIG. 1 and/or FIG. 17.
Figure 33:
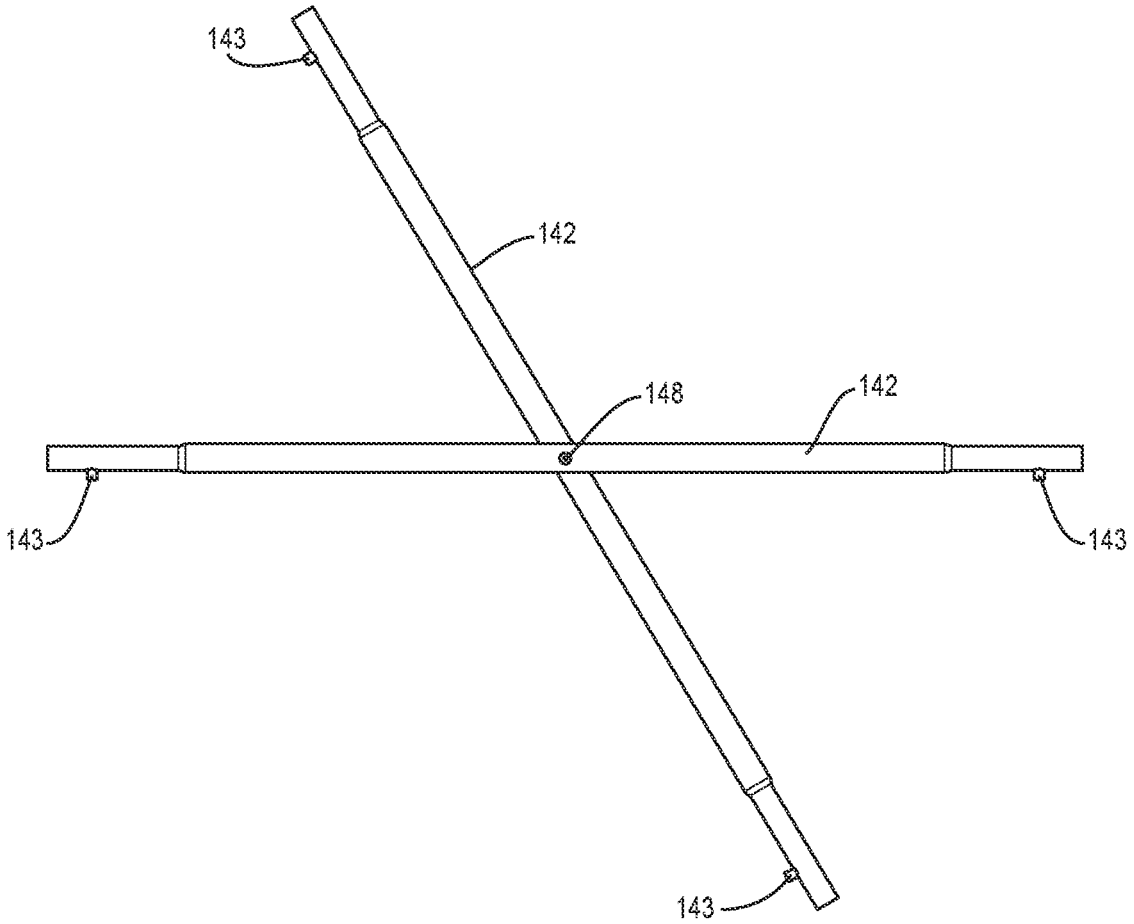
FIG. 33 shows a pair of center segments of the cross braces of FIG. 32, pivotally connected together.
Figure 34A:
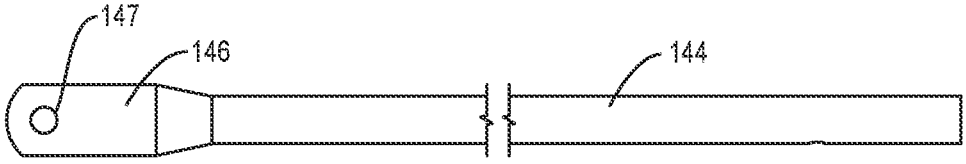
FIGS. 34A-34B show an end segment of the cross braces of FIG. 32.
Figure 34B:
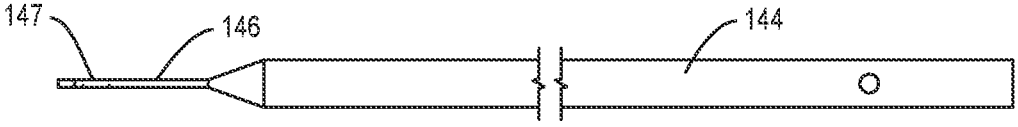

In some embodiments, the cross braces 14 may be unitary, and optionally pivotably connected together. However, in order to facilitate compact storage, the cross braces 14 may advantageously be telescoping and/or composed of multiple segments releasably connected in series. For example, the cross braces 14 of FIG. 32 each include three segments that are releasably connected in series. Each cross brace 14 includes a center segment 142 and respective end segments 144. The end segments 144 each overlap the center segment slightly and are releasably connected to the center segment 142 by a spring-based detent 143 in the center segment 142 that engages a corresponding hole in the end segment 144 (the male/female detent relationship may be reversed if desired). The end segments 144 advantageously have flattened outboard end portions 146 that include a suitable hole 147 for receiving the corresponding latch posts 100. When assembled, the end segments 147 form a collinear series with the center segment 142. When disassembled, the end segments 144 are distinct from the center segment 142, but may be placed generally parallel to and beside the center segment 142, thereby reducing the length required to store the cross brace 14 in the collapsed or disassembled state. As shown in FIG. 32, the cross braces 14 for one side of the scaffold 10 may optionally be pivotally connected together so as to be rotatable relative to each other about a brace axis 148 by any suitable means. The disassemble-able type cross braces 14 may be used with any of the scaffolds 10 disclosed herein.

It should be noted that the positioning of the latch posts is substantially farther apart than in conventional scaffolds. The lower latch post 10 on each vertical support 20 is below the location of the lower horizontal support 30, and the upper latch post is located close to the upper horizontal support. For example, the latch posts 100 may be located approximately forty-eight inches apart on a five foot tall vertical support 20. The spacing of the latch posts 100 increases stability of the scaffold 10 when assembled.

A method (300) of using the scaffold 10 may begin with the scaffold 10 being transported to a work site location in a loose configuration (e.g., fully disassembled). The general process includes forming (310) one or more ladder frames 12, and interconnecting (330) at least two of the ladder frames 12 with cross braces 14. The first ladder frame 12 is formed by releasably mounting (312) upper horizontal support 30 between first and second outer vertical supports 20 by securing a plurality of releasable connections 600. The lower horizontal support 30 is also releasably mounted (314) between the first and second outer vertical supports 20 by securing another plurality of releasable connections 600. The forming (310) of the first ladder frame 12 optionally includes mounting (316) center support 40 to the upper and lower horizontal supports 30 via suitable releasable connections 600. The forming (310) of the first ladder frame 12 optionally includes mounting (318) a plurality of rungs 50 to the first outer vertical support 20, between the upper and lower horizontal supports 30, via an additional plurality of the releasable connections 600. The releasable connections 600 are as described above. For example, each releasable connection 600 comprises a male wedge protrusion 614 received in a female receiver 632 (e.g., flange 632) having a passage 634 therethrough, the passage 634 having a tapered interior wall surface 636. The male wedge protrusions 614 are associated with the horizontal supports 30 and the female flanges 632 are associated with the vertical supports 20. The male wedge protrusion 614 and the tapered interior wall surface 636 abut when the releasable connection 600 is secured, such as by tightening the corresponding fastener 67. For example, the releasable connections 600 may be used to secure the components together by inserting a first male wedge protrusion 614 associated with a first end of the upper horizontal support 30 into a first female flange 632 on the first outer vertical support 20; and thereafter tightening a fastener 67 onto a threaded tip portion 624 of male protrusion 614 so as to hold an unthreaded angled bearing surface 618 of the first male wedge protrusion 614 against a tapered interior wall surface 636 of the first female flange 632, to thereby inhibit movement of the upper horizontal support 30 relative to the first outer vertical support 20, such as rotation relative to longitudinal axis 23 of the first outer vertical support 20.

The second ladder frame 12 is optionally formed (320) in a similar fashion, and the second ladder frame 12 is optionally substantially identical to the first ladder frame 12. The process continues with interconnecting (330) the first ladder frame 12 to second ladder frame 12 to form a rigid structure using a plurality of cross braces 14, with each cross brace 14 mounted to both the first ladder frame 12 and the second ladder frame 12. The formed scaffold 10 is then used, such as by placing a deck on the ladder frames 12, and thereafter performing work, such as painting.

The method optionally further includes, thereafter, disassembling (350) the scaffold 10 by: 1) disconnecting (352) the first ladder frame 12 from the second ladder frame 12 by dismounting the cross braces 14 from at least the first ladder frame 12; and 2) disassembling (354) the first ladder frame 12 such that the upper horizontal support 30, the lower horizontal support 30, the first and second outer vertical supports 20 are all dismounted from each other. The second ladder frame 12 is advantageously also similarly disassembled.

Note that, as an example, the forming of the first ladder frame 12 conceptually occurs at the first work site location, and the method may optionally include thereafter, disassembling (354) the first ladder frame 12 (as described above) at the first work site location, and thereafter, transporting (360) the first ladder frame 12 to a second work site location remote from the first work site location, and while at the second work site location re-forming (370) the scaffold 10 as a rigid structure by at least re-forming first ladder frame 12.

The ability of the ladder frames 12 and/or cross braces 14 to be repeatedly disassembled and reassembled allows one or more embodiments of the scaffold 10 to compactly and efficiently stored. For example, for a scaffold 10 with five foot high ladder frames 12 and about seven foot long cross braces 14, forming an approximately five foot wide by five foot tall by seven foot tall scaffold 10, may be stored (e.g., after disassembly) with the ladder frames 12 and the cross braces 14 unassembled/disassembled in a suitable box having dimensions of about six and one half inches wide by five inches tall by not more than about seventy, and advantageously about sixty-one inches, long or less. Storage in a such a box is both convenient and allows for easier stocking/storage of the scaffold 10 by sellers and/or users.

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A collapsible scaffold, comprising:

first and second ladder frames, each comprising:

a plurality of vertical supports;

a plurality of horizontal supports configured to be releasably connected to the vertical supports to enable disassembly of the ladder frames into component parts for storage or transport;

a plurality of releasable connections for releasably connecting the horizontal supports to the vertical supports to form a rigid ladder frame structure;

a plurality of cross braces, each configured to be releasably connected to both the first and second ladder frames to form a self-supporting scaffold;

wherein each of the releasable connections comprise:

a male wedge protrusion affixed to one of a vertical support and a horizontal support; and a female receiver affixed to the other of the vertical support and the horizontal support, the female receiver having a passage therethrough with a tapered interior surface, the passage configured to receive the male wedge protrusion when inserted into the female receiver along an insertion axis when the vertical support and horizontal support are joined;

a threaded fastener configured to secure the male wedge protrusion in the female receiver when the vertical support and horizontal support are joined, with the threaded fastener extending longitudinally parallel to the insertion axis and the insertion axis extending through the passage in the female receiver.

2. The scaffold of claim 1, wherein the male wedge protrusion has a non-round cross-section normal to the insertion axis.

3. The scaffold of claim 1:

wherein a first male wedge protrusion is mounted to an upper horizontal support that has a longitudinal axis, and wherein the first male wedge protrusion extends transverse to the longitudinal axis;

wherein a first female receiver is mounted to a first vertical support having a longitudinal axis, and wherein the passage of the first female receiver is oriented parallel to the longitudinal axis of the first vertical support.

4. The scaffold of claim 3:

wherein the upper horizontal support comprises a pair of inserts, disposed on longitudinal ends thereof, that are permanently affixed to a longitudinal rail member so as to extend partially therefrom;

wherein each insert includes a corresponding male wedge protrusion.

5. The scaffold of claim 4, wherein the inserts have channels therein for partially receiving the corresponding vertical supports.

6. The scaffold of claim 1:

wherein the male wedge protrusions and the threaded fasteners form a unitary structure with a threaded tip;

wherein the releasable connections each further comprise:

a hole configured to receive the threaded tip, with the threaded tip extending farther from the tapered interior surface than the hole;

a nut configured to threadably engage the threaded tip on a side of the hole opposite the tapered interior surface to secure male wedge portion in the passage when tightened.

7. The scaffold of claim 6, wherein the male wedge protrusion has a flat bearing face; wherein the flat bearing face presses against the tapered interior surface of the female receiver when the corresponding ladder frame is in an assembled state with the fastener tightened.

8. The scaffold of claim 1, wherein the threaded fastener is distinct from the male wedge protrusion and insertable into the male wedge protrusion.

9. The scaffold of claim 1, wherein the first ladder frame comprises:

first and second outer vertical supports;

an inner vertical support;

upper and lower horizontal supports; and one or more rungs configured to be releasably mounted to both the first outer vertical support and the inner vertical support.

10. The scaffold of claim 9, wherein the second ladder frame is substantially identical to the first ladder frame.

11. The scaffold of claim 1:

wherein the scaffold is changeable between a rigid configuration and a loose configuration;

wherein, in the rigid configuration:

the first and second ladder frames are in assembled states with the horizontal supports mounted to the vertical supports via a plurality of the releasable connections to form a rigid ladder frame structure; and the cross braces are secured to both the first and second ladder frames;

wherein, in the loose configuration:

the first and second ladder frames are both in disassembled states with the horizontal supports and the vertical supports dismounted from each other; and the cross braces are dismounted from both the first and second ladder frames.

12. The scaffold of claim 11, wherein, in the rigid configuration, the cross braces are secured to both the first and second ladder frames by latch connections.

13. The scaffold of claim 1, wherein the first ladder frame comprises releasable connections of at least two different sizes.

14. A method of using a scaffold:

forming a first ladder frame by:

releasably mounting an upper horizontal support between first and second outer vertical supports by securing a plurality of releasable connections;

releasably mounting a lower horizontal support between the first and second outer vertical supports by securing another plurality of releasable connections;

wherein each of the releasable connections comprises a male wedge protrusion received in a female receiver having a passage therethrough, the passage having a tapered interior surface; wherein the male wedge protrusions are associated with the horizontal supports and the female receivers are associated with the vertical supports; wherein the male wedge protrusion and the tapered interior surface abut when the releasable connection is secured;

wherein securing each releasable connection comprises:

inserting the male wedge protrusion into the passage of the corresponding female receiver along a corresponding insertion axis;

tightening a nut onto a threaded fastener to secure the releasable connection with the male wedge protrusion in the corresponding female receiver;

wherein the threaded fastener extends longitudinally parallel to the insertion axis and the insertion axis extends through the passage in the female receiver; and connecting the first ladder frame to a second ladder frame to form a rigid self-supporting structure via a plurality of cross braces, wherein each cross brace is mounted to both the first ladder frame and the second ladder frame.

15. The method of claim 14, wherein forming the first ladder frame further comprises mounting a plurality of rungs to the first outer support, between the upper and lower horizontal supports, via an additional plurality of the releasable connections.

16. The method of claim 14, wherein the second ladder frame is substantially identical to the first ladder frame.

17. The method of claim 14, further comprising thereafter, disassembling the scaffold by:

disconnecting the first ladder from the second ladder frame by dismounting the cross braces from at least the first ladder frame;

disassembling the first ladder frame such that the upper horizontal support, the lower horizontal support, the first and second outer vertical supports are all dismounted from each other.

18. The method of claim 14, wherein forming the first ladder frame comprises:

inserting a first male wedge protrusion associated with a first end of the upper horizontal support into a first female receiver on the first outer vertical support;

thereafter tightening a fastener onto a threaded portion of male protrusion so as to hold an unthreaded angled bearing surface of the first male wedge against a tapered interior surface of the first female receiver, to thereby inhibit angular movement of the upper horizontal support relative to a longitudinal axis of the first outer vertical support.

19. The method of claim 14:

wherein forming the first ladder frame occurs at a first work site location;

thereafter, disassembling the first ladder frame at the first work site location, wherein the disassembling is such that the upper horizontal support, the lower horizontal support, the first and second outer vertical supports are all dismounted from each other;

thereafter, transporting the first ladder frame to a second work site location remote from the first work site location, and while at the second work site location re-forming the rigid structure by at least re-forming first ladder frame.

20. A method of constructing a scaffold, comprising:

forming a first ladder frame by connecting two or more horizontal supports between two outer vertical supports, wherein the connecting comprises:

engaging male wedge protrusions affixed to one of the outer vertical supports and the horizontal supports with a corresponding female receiver affixed to the other of the vertical supports and the horizontal supports; the female receiver having a passage therethrough with a tapered interior surface and configured to receive the male wedge protrusion when the vertical support and horizontal support are joined; the engaging comprising inserting the corresponding male wedge protrusion into the passage of the corresponding female receiver along an insertion axis; and securing the male wedge protrusions in the passages of respective female receivers using threaded fasteners by tightening a nut onto a threaded fastener to secure the male wedge protrusion in the corresponding female receiver; wherein the threaded fastener extends longitudinally parallel to the insertion axis and the insertion axis extends through the passage in the female receiver; and connecting a plurality of cross braces between the first ladder frame to a second ladder frame to form a rigid, self-supporting structure.

* * * * *